US011473288B2

(12) United States Patent
Kolisnek

(10) Patent No.: US 11,473,288 B2
(45) Date of Patent: Oct. 18, 2022

(54) MODULAR PROTECTIVE ENCLOSURE FOR OUTDOOR EQUIPMENT

(71) Applicant: Kurtis Kolisnek, Airdrie (CA)

(72) Inventor: Kurtis Kolisnek, Airdrie (CA)

( * ) Notice: Subject to any disclaimer, the term of this patent is extended or adjusted under 35 U.S.C. 154(b) by 0 days.

(21) Appl. No.: 17/140,185

(22) Filed: Jan. 4, 2021

(65) Prior Publication Data

US 2021/0395994 A1 Dec. 23, 2021

Related U.S. Application Data

(63) Continuation-in-part of application No. 16/908,844, filed on Jun. 23, 2020.

(51) Int. Cl.

| | |
|---|---|
| ***E04B 1/14*** | (2006.01) |
| ***E04B 1/344*** | (2006.01) |
| ***E04B 2/58*** | (2006.01) |
| ***E04C 2/292*** | (2006.01) |
| ***E04C 2/296*** | (2006.01) |
| ***E04C 2/30*** | (2006.01) |
| ***E04H 1/12*** | (2006.01) |
| ***E21B 41/00*** | (2006.01) |
| *E04C 2/00* | (2006.01) |

(52) U.S. Cl.

CPC ..... *E04B 1/14* (2013.01); *E04B 1/344* (2013.01); *E04B 2/58* (2013.01); *E04C 2/292* (2013.01); *E04C 2/296* (2013.01); *E04C 2/30* (2013.01); *E04H 1/1205* (2013.01); *E21B 41/00* (2013.01); *E04B 2103/04* (2013.01); *E04B 2103/06* (2013.01); *E04C 2002/004* (2013.01)

(58) Field of Classification Search

CPC ... E04B 1/14; E04B 1/344; E04B 2/58; E04B 2103/04; E04B 2103/06; E04C 2/292; E04C 2/296; E04C 2/30; E04C 2002/004; E04H 1/1205; E21B 41/00

USPC ..... 52/79.1

See application file for complete search history.

(56) References Cited

U.S. PATENT DOCUMENTS 2,765,500 A ‡ 10/1956 Campus ..... E04B 1/34321 52/91.1

3,113,401 A * 12/1963 Jessup ..... E04B 1/54 52/417

(Continued)

*Primary Examiner* — Brian D Mattei

*Assistant Examiner* — Joseph J. Sadlon

(74) *Attorney, Agent, or Firm* — Lewellyn Law, PLLC; Stephen Lewellyn

(57) ABSTRACT

A protective enclosure for equipment located outside, such as, for example pipeline and wellhead valves, dewatering pumps, etc. includes a wall frame assembly constructed of a plurality of vertical frame members that are connected together at their tops and bottoms by a plurality of angle-iron members. Wall assemblies comprising insulated wall panels that are connected in a side-by-side relation by tongue-and-grove couplings are attached to the wall frame with the bottoms thereof supported on angle-iron members that connect the bottoms of the vertical frame members. A roof assembly can be attached to the wall frame in a stationary fashion or in a movable fashion to allow the roof to open, permitting access into the enclosure for servicing equipment housed therein. The enclosure has other features as described in the specification in further detail.

17 Claims, 28 Drawing Sheets

(56) References Cited

U.S. PATENT DOCUMENTS 3,236,014 A ‡ 2/1966 Norman ..... E04B 1/14 52/270
3,546,831 A ‡ 12/1970 Kratky ..... E04B 1/34321 52/115
3,675,379 A ‡ 7/1972 Lambert ..... E04B 1/08 52/264
3,807,105 A * 4/1974 Rudkin, Jr. ..... E04B 1/34815 52/80.1
3,867,995 A * 2/1975 Sanders ..... E04B 1/8218 52/406.1
4,125,972 A ‡ 11/1978 Pate ..... E04B 1/14 52/220.2
4,346,543 A * 8/1982 Wilson ..... E04D 13/1618 52/410
4,512,120 A ‡ 4/1985 Lindal ..... E04B 1/34321 52/143
4,570,392 A ‡ 2/1986 Oilman ..... E04H 1/1205 52/64
4,588,190 A ‡ 5/1986 Stewart ..... A63B 69/0097 273/395
4,662,288 A * 5/1987 Hastings ..... H05K 7/20 428/920
4,880,026 A * 11/1989 Ferre ..... B60S 3/002 137/234.6
4,919,210 A ‡ 4/1990 Schaefer, Jr. ..... E21B 33/037 166/356
4,964,252 A ‡ 10/1990 Guliker ..... E04H 1/1238 220/1
5,033,489 A ‡ 7/1991 Ferre ..... B60S 3/008 134/57 R
5,207,036 A * 5/1993 Sampson ..... E04D 13/0354 52/72
5,212,914 A * 5/1993 Martin ..... E04F 13/12 52/235
5,293,725 A ‡ 3/1994 Matticks ..... E04B 1/34315 52/126
5,331,778 A ‡ 7/1994 Mazpule ..... E04B 1/34321 52/264
5,424,118 A * 6/1995 McLaughlin ..... E04B 1/6183 428/314.8
5,571,230 A * 11/1996 Berg ..... E04B 1/24 52/271
5,921,047 A ‡ 7/1999 Walker ..... E04B 1/6141 52/585
5,960,592 A ‡ 10/1999 Lilienthal, II ..... E04H 1/1238 52/745
6,349,510 B1 ‡ 2/2002 Haas ..... E04H 1/1238 52/143
6,561,215 B1 ‡ 5/2003 Wakefield ..... E04H 1/1238 137/36
6,604,328 B1 * 8/2003 Paddock ..... E04B 1/34315 52/264
6,786,009 B1 ‡ 9/2004 McGunn ..... A47B 47/03 312/263
6,802,158 B1 ‡ 10/2004 Greene ..... E04H 1/1205 52/270
6,892,497 B2 ‡ 5/2005 Moon ..... E04B 1/34321 52/270
7,003,863 B2 ‡ 2/2006 Skov ..... A47F 5/0815 29/453
7,076,922 B1 * 7/2006 Parres ..... E04B 1/8218 52/646
7,100,332 B2 * 9/2006 Loesch ..... E02D 27/01 52/143
8,156,690 B2 * 4/2012 Higley ..... E04B 1/12 52/79.5
8,429,857 B2 ‡ 4/2013 Melrose ..... E04H 9/10 52/79.1
8,621,806 B2 * 1/2014 Studebaker ..... F16B 33/06 52/319
8,635,828 B2 * 1/2014 Bahnmiller ..... B32B 27/12 52/762
8,683,753 B2 ‡ 4/2014 Bachorz ..... E04B 1/80 52/79.5
8,769,898 B2 * 7/2014 Carolan ..... E04B 2/90 52/235
8,833,025 B2 * 9/2014 Krause ..... E04F 13/0821 52/489.1
9,376,801 B1 * 6/2016 Warren ..... E04H 5/02
10,206,501 B1 * 2/2019 Kindred, Jr. ..... A47B 43/04
10,663,090 B2 * 5/2020 Paetow ..... B60S 3/002 137/234.6
10,889,984 B2 ‡ 1/2021 Arguin ..... E04F 13/0894
2001/0010137 A1 * 8/2001 Jimenez Sanchez ..... E04H 1/1238 52/79.1
2002/0046521 A1 ‡ 4/2002 Steinacker, Sr. ..... E04C 2/044 52/274
2006/0048459 A1 * 3/2006 Moore ..... E04B 1/34321 52/79.1
2007/0096505 A1 ‡ 5/2007 Haack ..... B60P 3/34 296/165
2012/0073215 A1 * 3/2012 Zhang ..... F02C 7/24 52/79.9
2012/0102871 A1 * 5/2012 Randall ..... E04B 1/34321 52/653.1
2014/0182220 A1 ‡ 7/2014 Hunt ..... C08G 14/10 52/79.9
2017/0241156 A1 * 8/2017 Earheart ..... A01M 31/025
2019/0234536 A1 ‡ 8/2019 Paetow ..... H02G 3/22
2021/0355672 A1 * 11/2021 Bryant ..... E04C 2/521

* cited by examiner
‡ imported from a related application

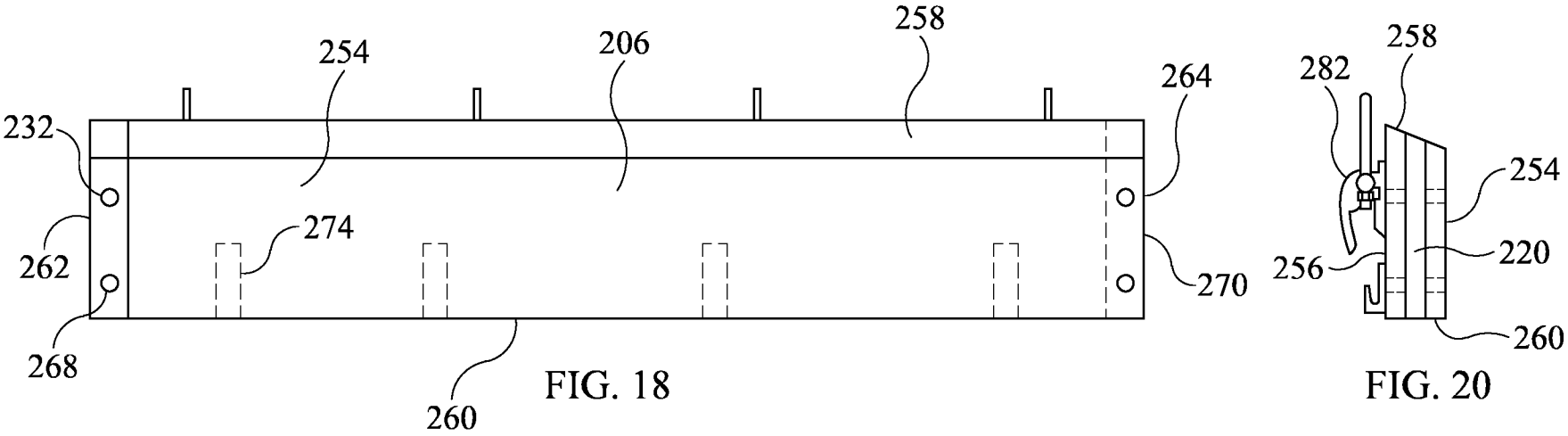
FIG. 18
FIG. 20
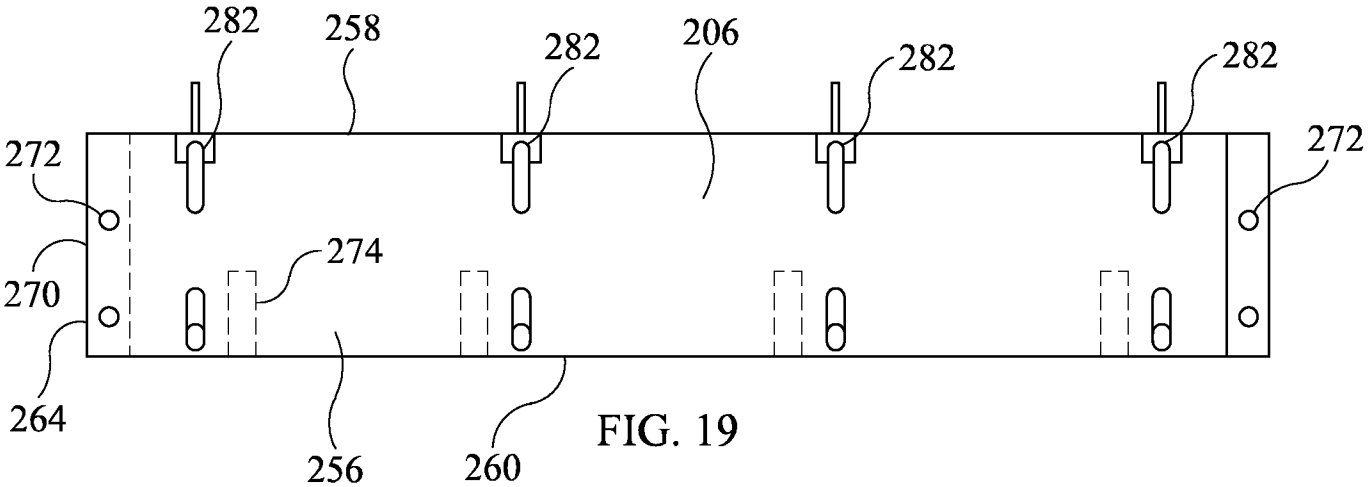
FIG. 19
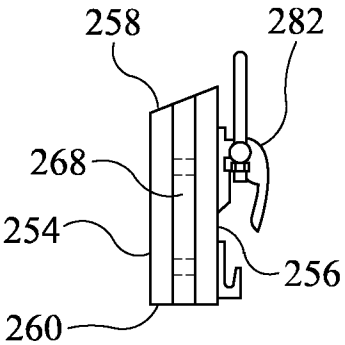
FIG. 21

MODULAR PROTECTIVE ENCLOSURE FOR OUTDOOR EQUIPMENT

CROSS-REFERENCE TO RELATED APPLICATIONS

This application is a continuation-in-part of U.S. application Ser. No. 16/908,844, filed Jun. 23, 2020, the entirety of which is incorporated herein by reference.

FIELD OF THE INVENTION

The present disclosure relates to enclosures for protecting equipment located outdoors, and more particularly to a protective enclosure having a modular construction.

BACKGROUND OF THE INVENTION

Certain equipment is installed outside, for example, wellheads and pipelines having valves. In cold climates, such equipment must be protected from exposure to prevent failing. In the pipeline and wellhead valve example, the current practice is to enclose the valve in plastic sheeting that is supported by a frame. The interior space created by the sheeting is then heated with large BTU portable heaters that are expensive to operate. The plastic sheeting enclosure often fails due to tearing caused by wind and/or snow and ice accumulating on the sheeting. Accordingly, there is a need and a desire for a new enclosure for protecting pipeline and wellhead valves and other equipment that is located outside in cold climates.

SUMMARY OF THE INVENTION

The present disclosure describes a portable, modular enclosure and system comprising structural panels having an insulated core. The enclosure and system that is configured to have limitless assemblies to provide an enclosure for equipment of various construction that are located outside and need protection from the weather. The enclosure is assembled at the equipment site and according to a configuration necessary to properly enclose and protect the equipment. As a non-limiting example, the equipment can be a pipeline valve, wellhead with one or more valves having long valve stems that move vertically during operation, a dewatering pump, or any other equipment desired to be maintained in an enclosure.

It is an object of embodiments of the invention to provide a versatile and insulated modular panel system that is easily portable and is used to create a temporary and heatable enclosure.

It is another object of embodiments of the invention to provide modular building construction having insulated panels connected by way of tongue and groove at the sides and lock together by way of a through bolt.

It is another object of embodiments of the invention to provide modular building construction that is easily portable and is used to create a modular and portable enclosure that can be heated to prevent critical equipment from freezing in winter months.

It is another object of embodiments of the invention to provide modular building construction with assembled enclosure shape is a square or rectangular shape, but if desired the enclosure can also be designed to be made and assembled in to an octagon shape, a pentagon shape, diamond shape or any angle of shape.

It is another object of embodiments of the invention to provide modular building construction wherein the insulated roof and wall panels have an exterior skin plus a separate second interior skin and a center insulation core that is sandwiched by the interior and exterior wall skins.

It is another object of embodiments of the invention to provide modular building construction wherein the skin layers of the walls and roof of the enclosure can be metal, polyurethane, polyethylene, or any other PVC product. If the panels are not skinned with metal and are skinned with polyurethane, polyethylene or any other PVC product, the wall skins and roof skins will be ribbed or grooved to provide strength to the wall & roof panels and the entire enclosure.

It is another object of embodiments of the invention to provide modular building construction wherein the insulation can be rigid Styrofoam insulation, batted insulation such as mineral wool, or even spray foam insulation.

It is another object of embodiments of the invention to provide modular building construction wherein the wall and roof include individual insulated panels.

It is another object of embodiments of the invention to provide modular building construction wherein the enclosure framing consists of square metal tubing and metal angle associated hardware.

It is another object of embodiments of the invention to provide modular building construction wherein insulated wall panels are placed on top of a metal angle that holds the wall panels in a straight and level place.

It is another object of embodiments of the invention to provide modular building construction that provides excellent soundproofing around the dewatering pumps, or other equipment that are used near residential areas.

It is another object of embodiments of the invention to provide modular building construction wherein one end wall of the insulated enclosure will need to swing open for easy replacement of equipment such as dewatering pumps. These dewatering pumps are trailer mounted pumps or pumps on skids that just get pulled out and around with a ½-ton truck or other heavy-duty equipment.

It is another object of embodiments of the invention to provide modular building construction wherein not the end walls, but the opposite walls that are the side walls and are stationary side walls with the man doors installed in them can have a manual damper or louvre racks to manually open the dampers due to the dewatering pump overheating. These dampers or louvre racks can open and close through temperature-controlled motor to open and close the damper/louvre system as required by the user. The reason for the dampers or louvres is that the pumps overheat if they are run too long and shut themselves off due to over temperature. The idea of this item is to create an extremely user-friendly system.

It is another object of embodiments of the invention to provide modular building construction wherein the roofs of the fully assembled enclosure can be opened up to remove a pipeline valve or other critical equipment that is stationary in which the enclosure is placed over.

It is another object of embodiments of the invention to provide modular building construction wherein in order to open the roofs of the fully assembled enclosure, the roof assembly will be hinged on one side of the roof assembly by way of a long strip hinge or piano hinge on the inside or outside of the lower side of the roof. This style of sloped roof will only have a strip hinge or piano hinge on one side of the roof assembly and a latching mechanism on the other side of the roof assembly.

It is another object of embodiments of the invention to provide modular building construction wherein the roof of the fully assembled enclosures is opened and closed by way of a hand cranked winch or electric winch with pulleys and airplane cable.

It is another object of embodiments of the invention to provide modular building construction wherein the enclosures will have 2 entry/exit doors to meet OH and S requirements.

It is another object of embodiments of the invention to provide modular building construction wherein the insulated modular panel enclosure system drastically improves energy efficiency of temporary enclosures.

It is another object of embodiments of the invention to provide modular building construction wherein the insulated modular panel enclosure system is easy to install with very minimal tools and only two unskilled people required to assemble the enclosure.

It is another object of embodiments of the invention to provide modular building construction wherein the enclosure is disassembled down to multiple singular pieces, placed on a small trailer and towed to the next set up location by ½ ton truck.

It is another object of embodiments of the invention to provide a modular building construction wherein the enclosure system is cost effective.

It is another object of embodiments of the invention to provide a modular building construction the enclosure drastically dampens sounds made from equipment running inside the fully assembled enclosure.

It is another object of embodiments of the invention to provide a modular building construction wherein the design of the enclosure permits enclosures to be as small as 7 ft high×7 ft wide×7 ft long or as large as 14 ft high×24 ft wide×100 ft+ in length.

It is another object of embodiments of the invention to provide a modular building construction wherein the enclosures is to provide an insulated enclosure that can be heated to keep critical equipment from freezing.

It is another object of embodiments of the invention to provide a modular building construction wherein the enclosure is designed to be placed over top pipelines and pipeline valves, around dewatering pumps, over oil well heads or anything that requires to be temporarily heated during winter months.

It is another object of embodiments of the invention to provide a modular building construction wherein the enclosure is a portable/mobile shop to easily set up and take down for pipeline service companies out in the field or a mobile garage for heavy duty equipment such as loaders, graders or trucks.

Numerous other objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there are illustrated embodiments of the invention.

BRIEF DESCRIPTION OF THE DRAWINGS

The following drawings illustrate by way of example and are included to provide further understanding of the invention for the purpose of illustrative discussion of the embodiments of the invention. No attempt is made to show structural details of the embodiments in more detail than is necessary for a fundamental understanding of the invention, the description taken with the drawings making apparent to those skilled in the art how the several forms of the invention may be embodied in practice. The same reference numeral may be used to indicate a similar feature or a feature with similar functionality. In the drawings:

FIG. 18 is an interior view of one embodiment of a short gable riser panel member of the protective enclosure;

FIG. 19 is an exterior view of one embodiment of a short gable riser panel member of the protective enclosure;

FIG. 20 is first end view of one embodiment of a short gable riser panel of the protective enclosure;

FIG. 21 is second end view of one embodiment of a short gable riser panel of the protective enclosure;

DETAILED DESCRIPTION OF THE INVENTION

Figure 1:
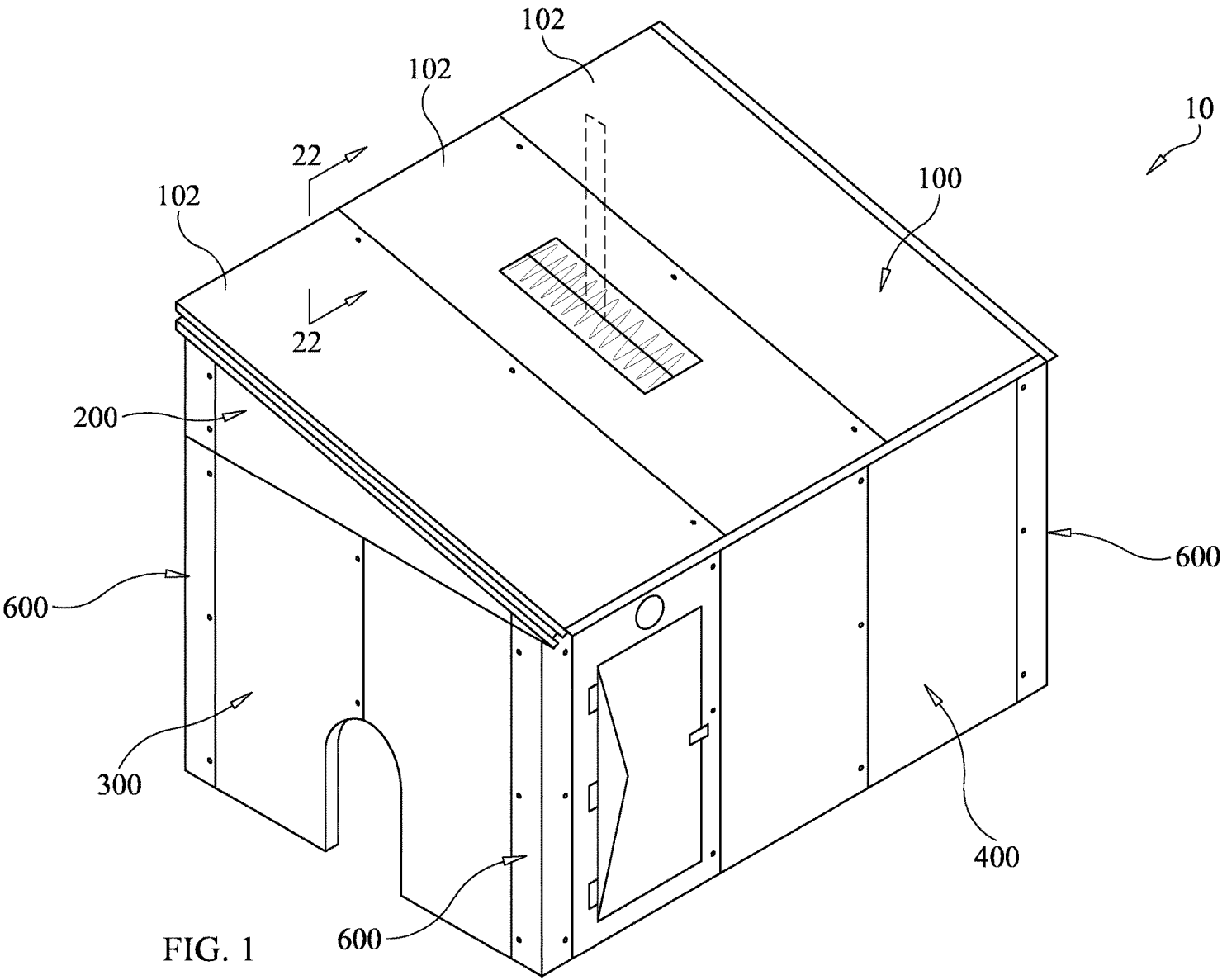
FIG. 1 is a perspective view of one embodiment of a protective enclosure constructed in accordance with the invention.

Reference now will be made in detail to embodiments of the invention, one or more examples of which are illustrated in the drawings. It will be readily understood that the components of the present invention, as generally described and illustrated in the drawings herein, could be arranged and designed in a wide variety of different configurations Thus, the following more detailed description of the embodiments of the assembly is not intended to limit the scope of the invention, as claimed, but it is merely representative of the presently preferred embodiments of the invention. It is intended that the present invention covers modifications and variations as come within the scope of the appended claims and their equivalents.

Figure 2:
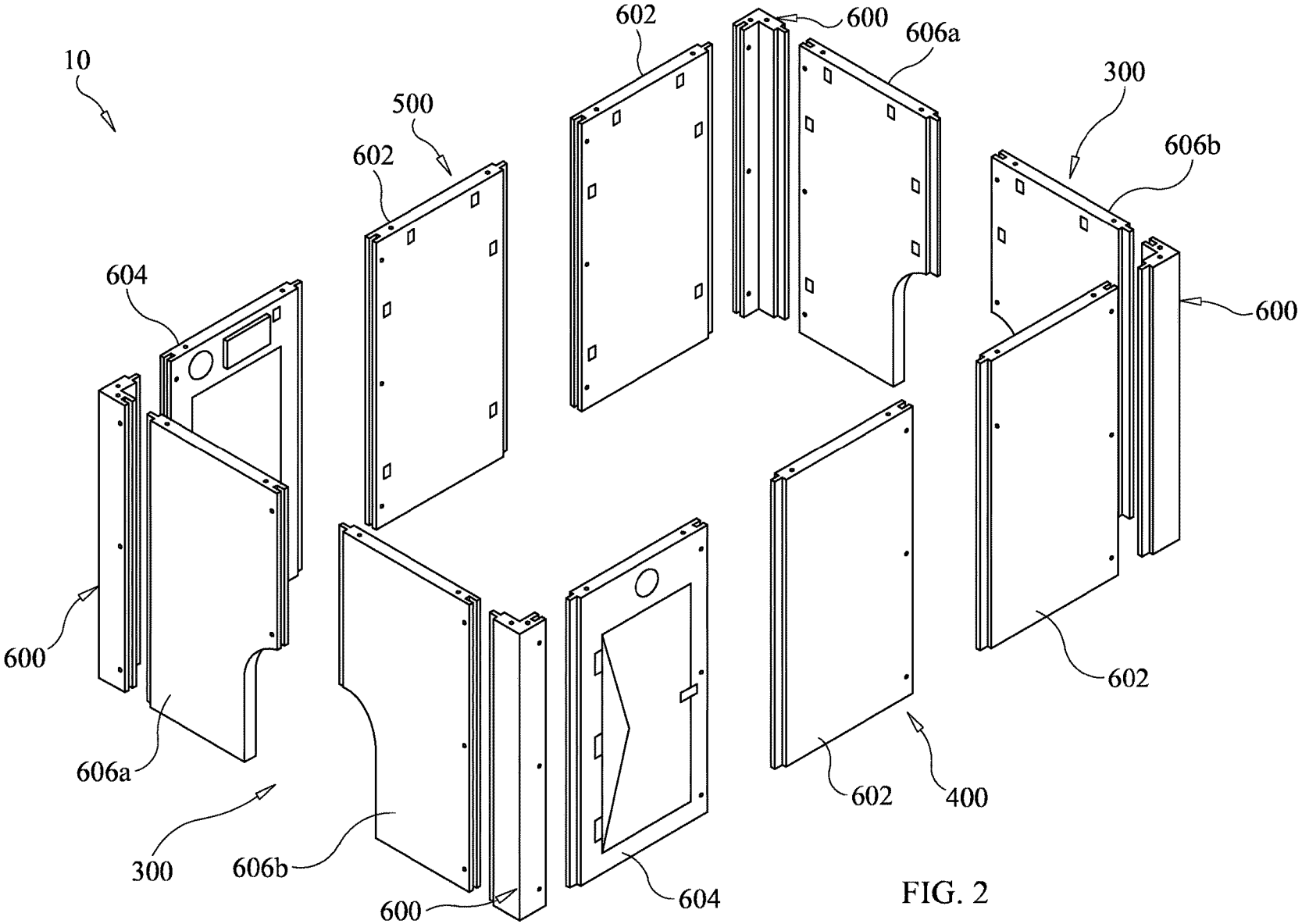
FIG. 2 is a partial, perspective exploded view of the enclosure of FIG. 1.
Figure 3:
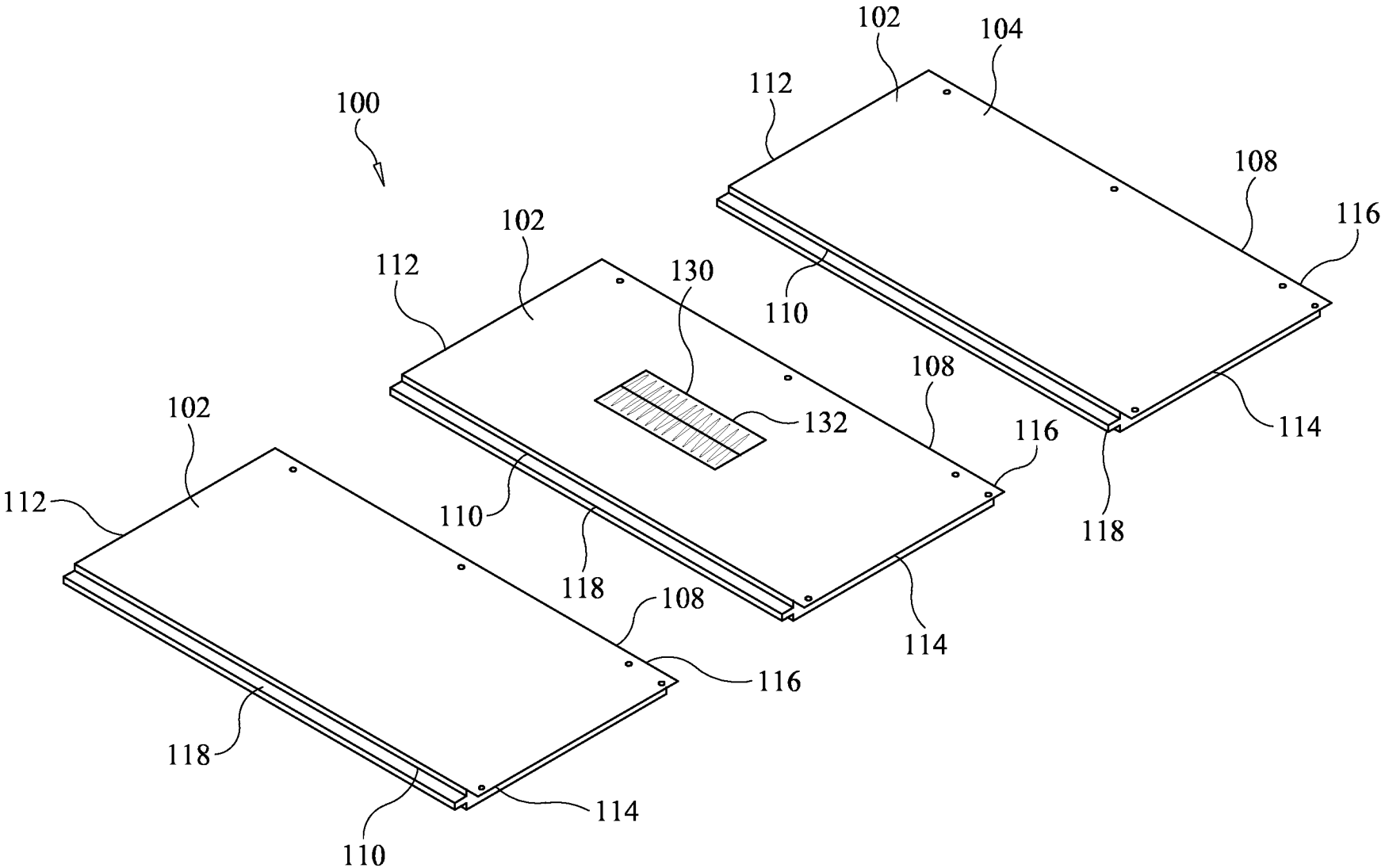
FIG. 3 is an exploded view of an embodiment of a roof assembly of the protective enclosure.
Figure 4:
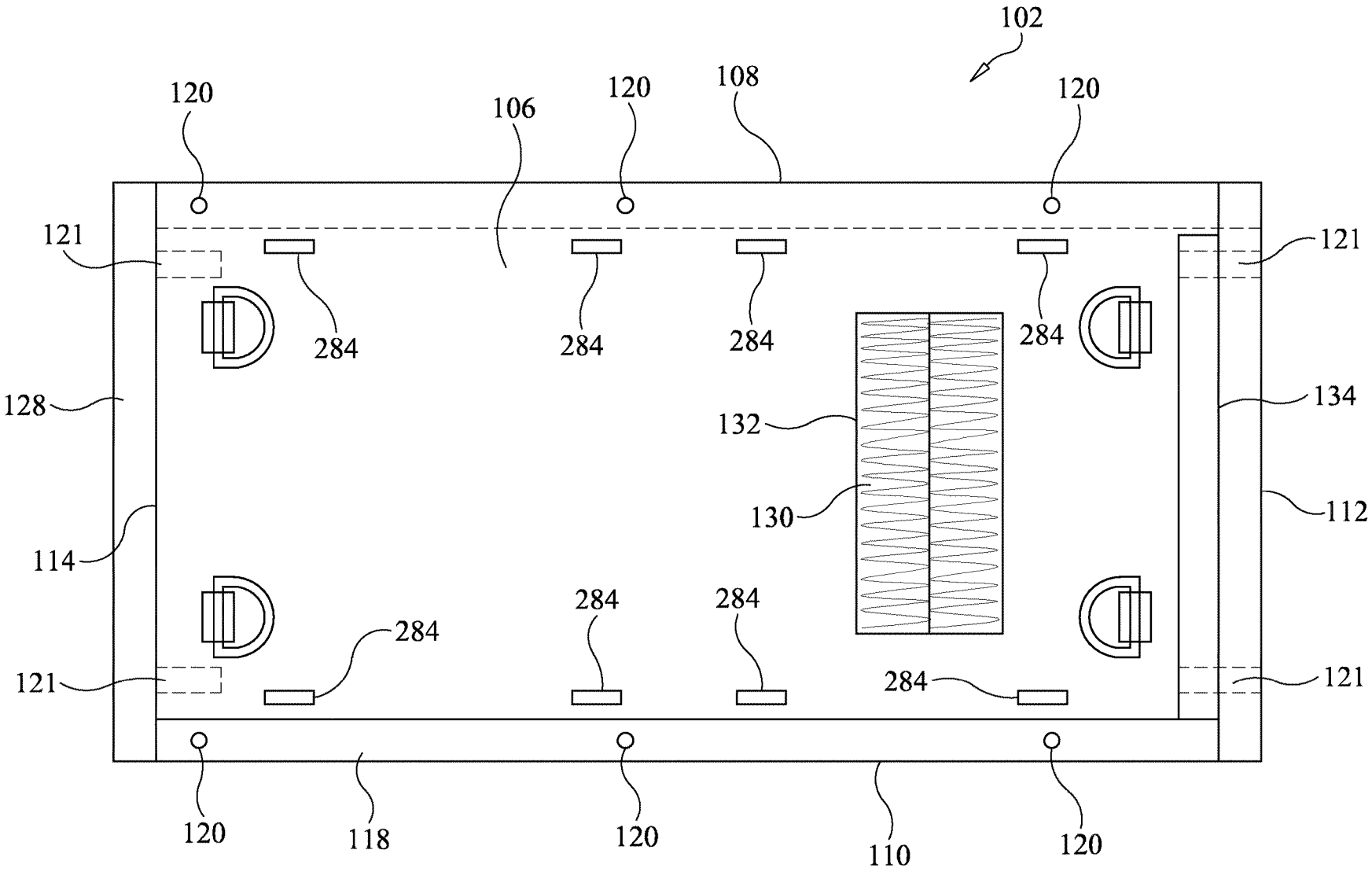
FIG. 4 is an interior view of one embodiment of a roof panel member of the protective enclosure.
Figure 5:
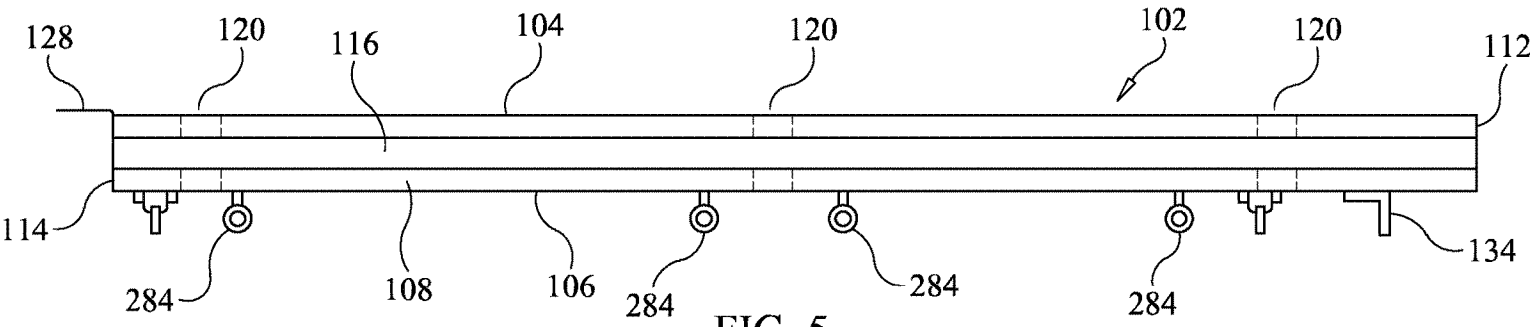
FIG. 5 is a first side view of one embodiment of a roof panel member of the protective enclosure.
Figure 6:
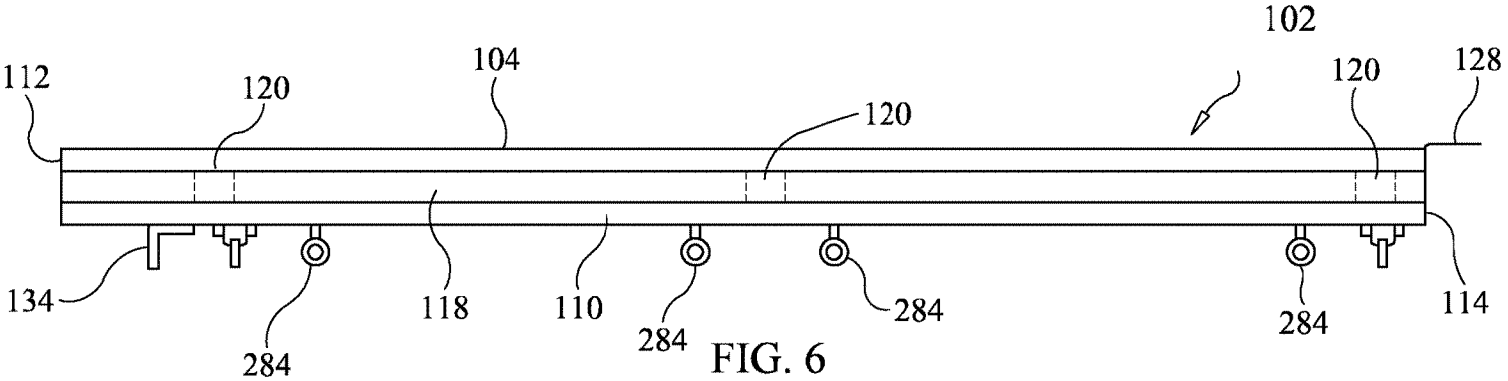
FIG. 6 is a second side view of one embodiment of a roof panel member of the protective enclosure.
Figure 8:
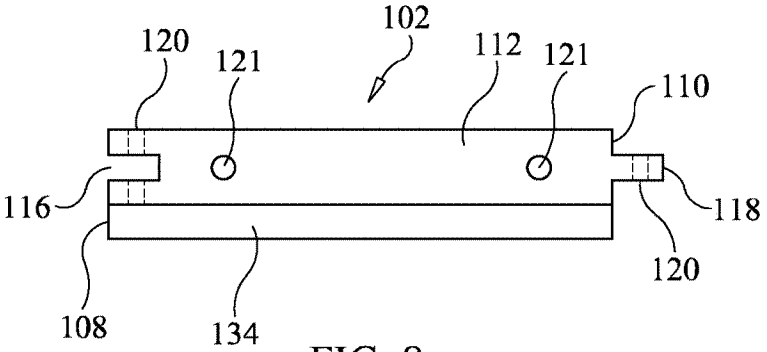
FIG. 8 is a second end view of one embodiment of a roof panel member of the protective enclosure.
Figure 7:
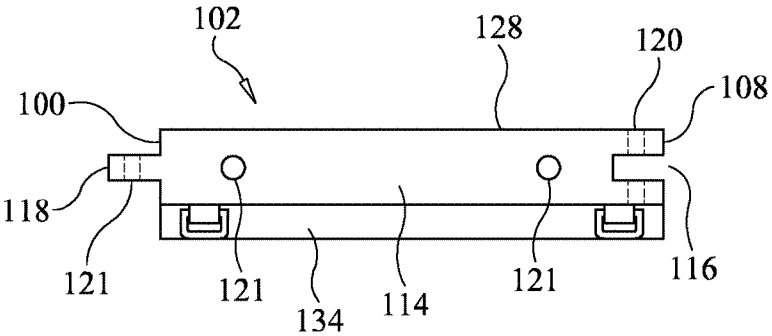
FIG. 7 is first end view of one embodiment of a roof panel member of the protective enclosure.

Referring to FIGS. 1-2, one embodiment of a protective enclosure system using modular, panels is shown and generally designated reference number 10. In the illustrated embodiment, enclosure 10 is constructed to protect a pipeline having a valve (not shown). The present disclosure is not limited to enclosures for protecting pipeline valves but can be employed to protect various equipment that is stored outside. An important aspect of the present disclosure is the modularity of the panels that allow for constructing enclosures of various sizes and shapes as desired to cover different equipment.

The enclosure includes a roof assembly 100, a gable assembly 200, and a plurality of sidewall assemblies, representatively shown comprising left and right sidewall assemblies 300, a front wall assembly 400, and a rear wall assembly 500, and a plurality of wall corner connector panels 600. In the preferred embodiment, the panels comprising the assemblies are constructed of a rigid foam core with a metal skin or cladding enclosing the rigid foam core, thereby providing insulated panels to a desired R rating. Alternatively, the core can be insulation core of any form or type as desired, such as, for example, rigid Styrofoam insulation, batted insulation such as mineral wool, or even spray foam insulation. Similarly, as an alternative, the metal skin could be metal, polyurethane, polyethylene, or any other PVC product.

As further shown and described herein, the panels comprising the assemblies are connected through various connectors in such a manner as to prevent separation of the panels in a plurality of directions. In representative embodiments, adjoining vertically oriented edges of the panels maybe connected through a tongue-and-groove coupling with the tongue along the edge of one panel and the groove along the edge of the other panel. Further, mechanical fasteners, such as, for example bolts may be used to tie the tongue and groove coupling together to prevent separation thereof. In some embodiments, adjoining longitudinally oriented edges of panels maybe connected through a pin-in-hole coupling. Additionally, mechanical couplings, such as, for example toggle latches, can be used to pull or cinch together the juxtaposed panels to further prevent separation of the panels in a plurality of directions.

With further reference to FIGS. 3-10, the roof assembly 100 encloses a top of the enclosure and may include one or more roof panel members 102 secured together in a substantially juxtaposed coplanar relationship. While the roof assembly 100 is representatively shown having three roof panel members 102 secured together side-by-side, it will become apparent that the roof panel members may also be connected end-to-end and side-by-side to form a roof having a desire length and width. In some embodiments, depending on the length and width, roof jacks (not shown) may be positioned within the enclosure and used to provide further support to the roof span. Further, in some embodiments, a single roof panel member 102 may be used.

Each roof panel member 102 includes a broad exterior side 104, an broad interior side 106 that is spaced from said broad exterior side defining a thickness therebetween a first edge 108, a second edge 110 opposite said first edge, a third edge 112 substantially perpendicular to and extending between the first and the second edges, a fourth edge 114 opposite to and substantially parallel to the third edge, wherein the distance between the third edge and the fourth edge defines a predetermined length. The first edge 108 has a groove 116 and the second edge 110 has a tongue 118. The tongue and grooves 116 and 118 may include through holes 120 spaced therealong, respectively, for receiving bolts. Each roof panel member 102 may also include pin receiving holes 122 that are formed through the third and fourth edges 112 and 114, respectively.

Figure 9:
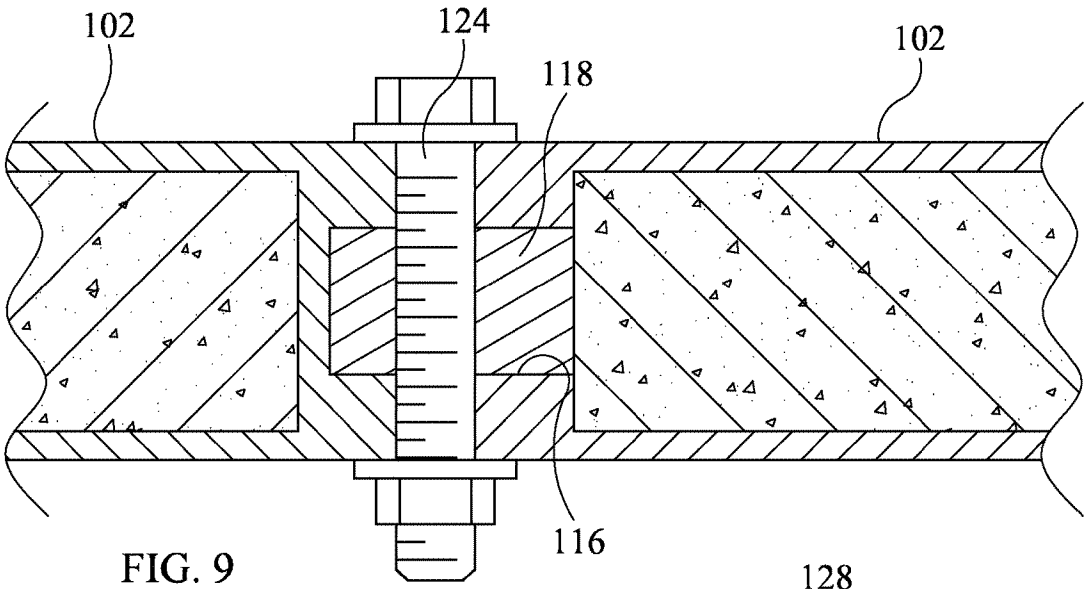
FIG. 9 is a cross-sectional view through a pair of roof panel members connected in a side-by-side coplanar relationship.
Figure 10:
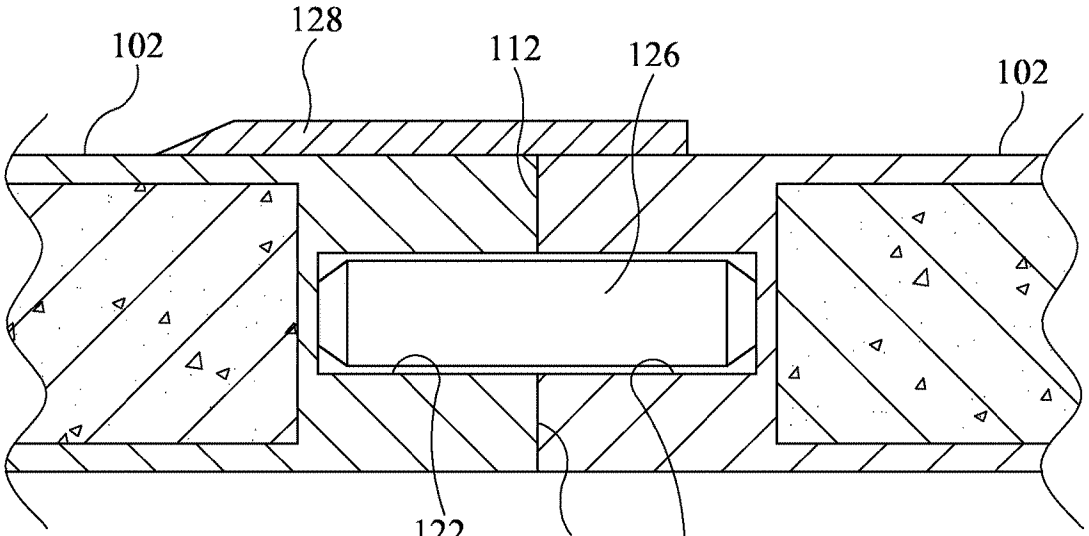
FIG. 10 is a cross-sectional view through a pair of roof panel members connected in an end-to-end coplanar relationship.

In FIG. 9, roof panel members 102 that are arranged side-by-side in a juxtaposed coplanar relationship may be connected by the tongue 118 of one panel disposed within the groove 116 of the adjoining panel. The tongue 118 can be secured in the groove 116 by one or more bolts 124 that is passed through cooperative holes 120 formed through the tongue and groove. In FIG. 10, roof panel members 102 that are arranged end-to-end in a juxtaposed coplanar relationship can be connected by one or more pins 126 received by cooperating arranged pin receiving holes 121 through edges 112 and 114, respectively. As further shown, edge 114 of roof panel members 102 may include a shiplap flange 128 to provide a lap over the adjoining roof panel member to prevent water from flowing through the adjoining edges.

As further shown in the representative embodiment, one or more roof panel members 102 may optionally include a bristle-brush seal 130 disposed within an opening 132 formed through the thickness of the panel. The seal 130 helps to prevent hot air from escaping from the interior of the protective enclosure when the roof panel is fitted with the opening 132 to allow a valve stem of a pipeline valve, for example, to extend through the opening in the roof. One or more roof panel members 102 may also have an L-shaped hanger 134 disposed on the interior broad side and along the third edge thereof so that the roof panel member can be supported at that edge during assembly of the enclosure.

Figure 11:
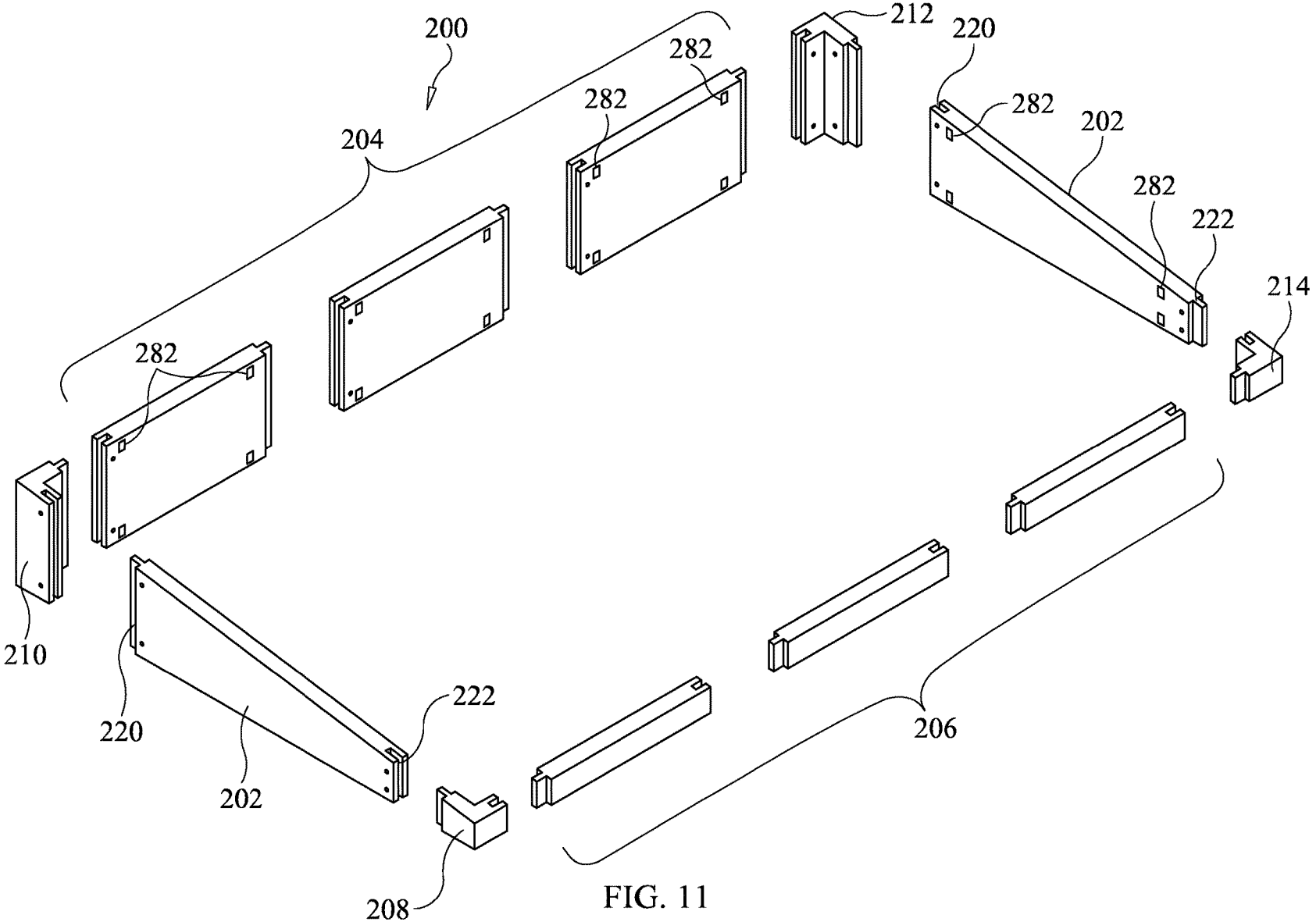
FIG. 11 is an exploded view of an embodiment of a gable assembly of the protective enclosure.
Figure 12:
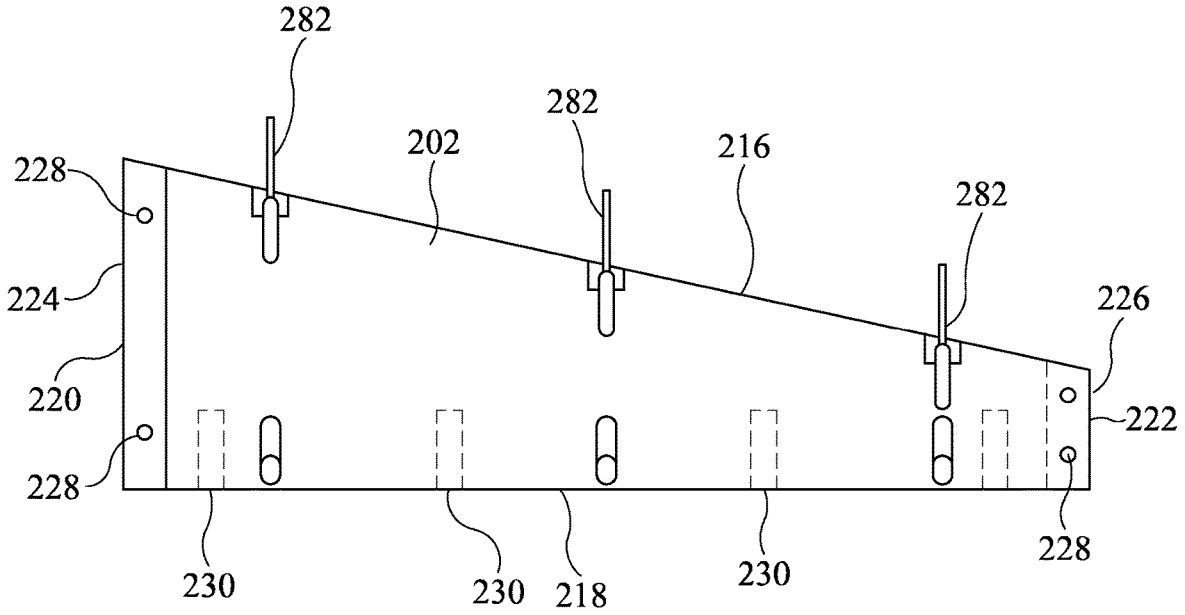
FIG. 12 is an interior view of one embodiment of a gable sidewall panel member of the protective enclosure.
Figure 13:
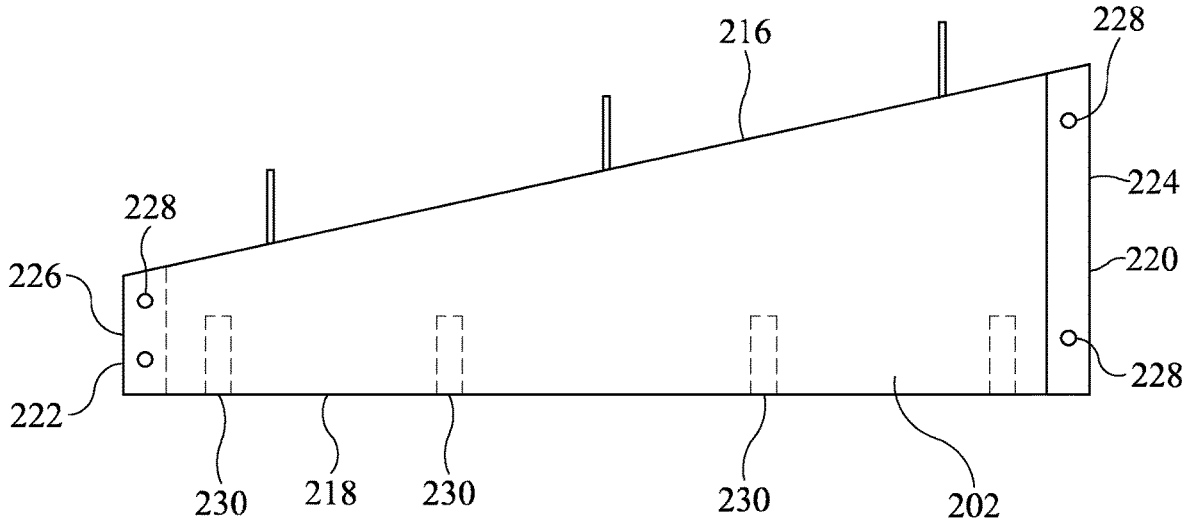
FIG. 13 is an exterior view of one embodiment of a gable sidewall panel member of the protective enclosure.
Figure 16:
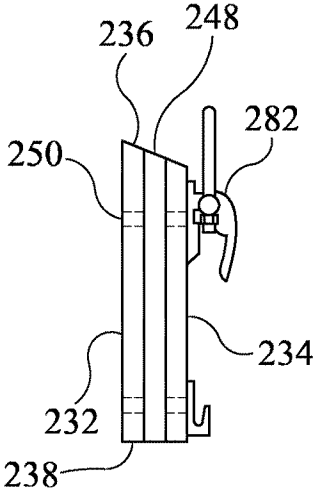
FIG. 16 is first end view of one embodiment of a tall gable riser panel of the protective enclosure.
Figure 17:
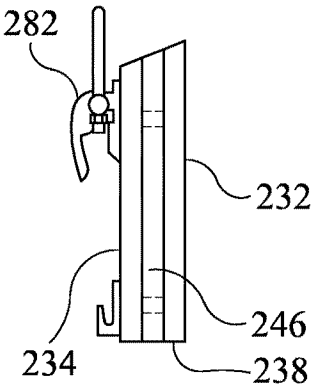
FIG. 17 is second end view of one embodiment of a tall gable riser panel of the protective enclosure.
Figure 14:
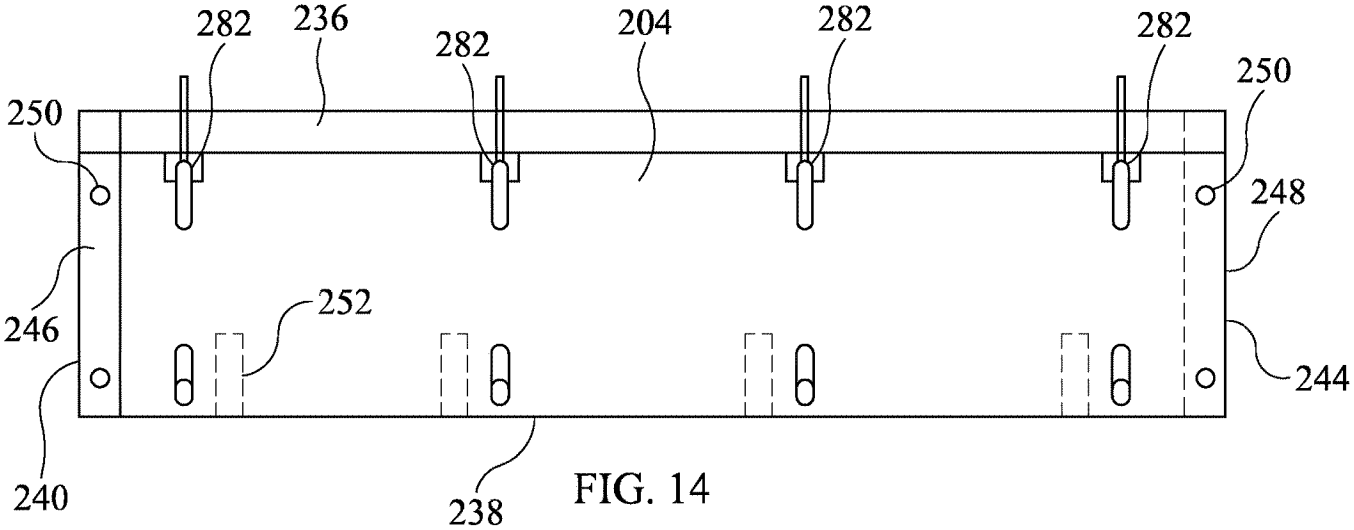
FIG. 14 is an interior view of one embodiment of a tall gable riser panel member of the protective enclosure.
Figure 15:
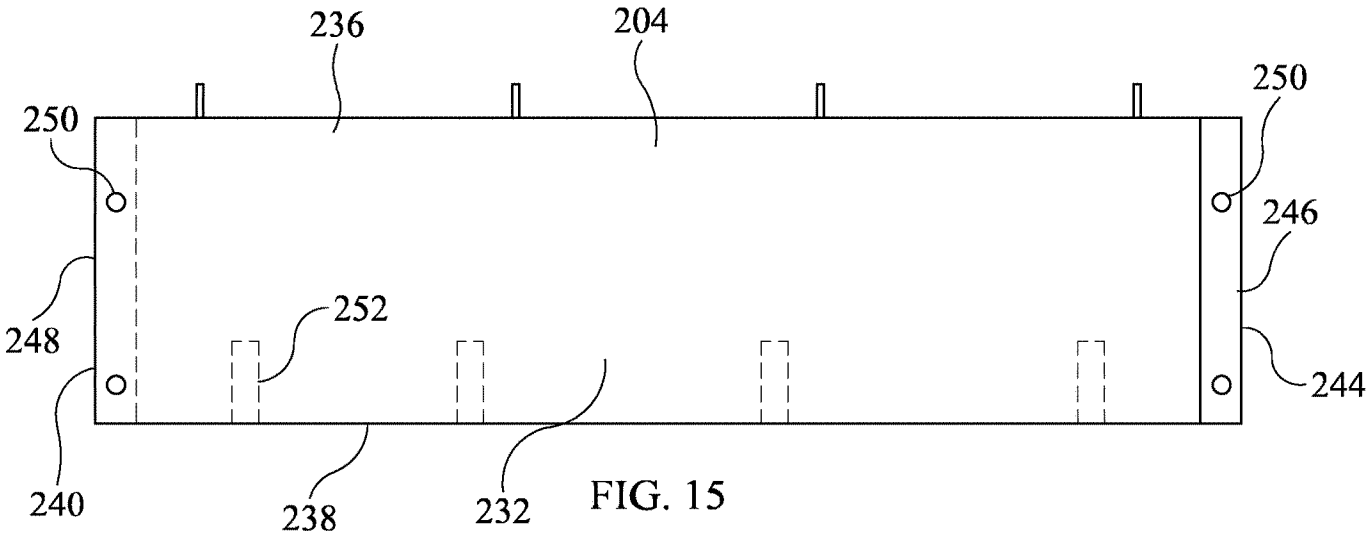
FIG. 15 is an exterior view of one embodiment of a tall gable riser panel member of the protective enclosure.

In FIG. 11, the gable assembly 200 includes gable sidewall panel members 202, a tall gable riser panel member 204, a short gable riser panel member 206, and a plurality of gable corner connectors 208-214. In FIGS. 12 and 13, each of the gable sidewall panel members 202 have a top edge 216, a bottom edge 218 opposite the top edge, a tall side edge 220 extending between the top and the bottom edges, and a short side edge 222 substantially parallel to the tall side edge. The top edge 216 slopes downwardly in a direction from the tall side edge 220 to the short side edge 222 to provide a proper roof slope to the roof assembly 100 when connected to the gable assembly 200.

The tall side edge 220 has a tongue 224 and the short side edge 222 has a groove 226. The tongue and grooves 224 and 226 may include through holes 228 spaced therealong, respectively, for receiving bolts. gable sidewall panel member 202 may also include pin receiving holes 230 that are formed through the bottom edge 218, respectively.

With further reference to FIGS. 14-17, the tall gable riser panel member 204 may be a single member or comprised of two or more panel members 204 connected in a juxtaposed coplanar relationship. Similarly, the short gable riser panel member 206 may be a single member or comprised of two or more panel members 206 connected in a juxtaposed coplanar relationship.

Each tall gable riser panel member 204 includes a broad exterior side 232, a broad interior side 234 that is spaced from said broad exterior side defining a thickness therebetween, a first edge 236, a second edge 238 opposite said first edge, a third edge 240 substantially perpendicular to and extending between the first and the second edges, a fourth edge 244 opposite to and substantially parallel to the third edge, wherein the distance between the third edge and the fourth edge defines a predetermined length. The third edge 240 has a tongue 246 and the fourth edge 244 has a groove 248. The tongue and grooves 246 and 248 may include through holes 250 spaced therealong, respectively, for receiving bolts. Each tall gable riser panel member 204 may also include pin receiving holes 252 that are formed through second edge 238, respectively. The first edge 236 slopes downwardly in a direction from the exterior side 232 to the interior side 234 to provide a proper roof slope to the roof assembly 100 when connected to the gable assembly 200.

With reference to FIGS. 18-21, each short gable riser panel member 206 includes a broad exterior side 254, a broad interior side 256 that is spaced from said broad exterior side defining a thickness therebetween, a first edge 258, a second edge 260 opposite said first edge, a third edge 262 substantially perpendicular to and extending between the first and the second edges, a fourth edge 264 opposite to and substantially parallel to the third edge, wherein the distance between the third edge and the fourth edge defines a predetermined length. The third edge 262 has a tongue 268 and the fourth edge 264 has a groove 270. The tongue and grooves 268 and 270 may include through holes 272 spaced therealong, respectively, for receiving bolts. Each short gable riser panel member 206 may also include pin receiving holes 274 that are formed through second edge 260, respectively. The first edge 258 slopes downwardly in a direction from the interior side 256 to the exterior side 254 to provide a proper roof slope to the roof assembly 100 when connected to the gable assembly 200.

As best seen in FIG. 11, in the gable assembly 200, the gable sidewall panels 204 are disposed substantially parallel to one another at a spaced distance therebetween and at opposing wall sides. The tall gable riser panel 204 extends between the tall side edges 224 of the gable sidewall panels, and the short gable riser panel 206 is substantially parallel to the tall gable riser panel and extends between the short side edges 222 of the gable sidewall panels. Gable corner connector panel 210 connects the tall side edge 220 of one gable sidewall panel 202 to one edge of said tall gable riser panel 204 via connector plate 274. A second gable corner connector panel 212 connects the tall side edge 220 of the second gable sidewall panel 202 to a second edge of said tall gable riser panel 204. A third gable corner connector panel 214 connects the short side of one gable sidewall panel 204 to one edge of said short gable riser panel 206 via connector plate 276. A fourth gable corner connector panel 208 connects the short side edge 222 of the second gable sidewall panel 202 to a second edge of the short gable riser panel 206.

A plurality of gable assembly to roof panel assembly securing members are arranged to secure the roof assembly 100 to the gable assembly 200 in such a manner as to prevent separation in a plurality of directions. In the preferred embodiment securing members are toggle latches 280 that are arranged on the roof assembly 100 and the gable assembly 200 such that upon engagement, latches 280 releasably fasten the roof assembly to the gable assembly. Such a fastening system is described by U.S. Published Patent Application Number 20120073215, the entirety of which is incorporated herein by reference. Latches 280 include a latch 282 that is configured to engage a mating engagement feature 284 that the latch 282 is coupled with, FIG. 22.

In FIG. 2, enclosure 10 has a plurality of sidewall assemblies 300, 400, and 500 at predetermined sides of the enclosure with the adjoining vertical ends of the sidewall assemblies being connected by wall corner connector panels 600. Each of the sidewall assemblies 300, 400, and 500 including one or more sidewall panel members 602, 604, and/or 606*a* and 606*b* connected in a juxtaposed coplanar relationship. Sidewall panel members 602 are provided walls, panel members 604 are sidewall door panel members, and panel members 606*a* and 606*b* each include one-half portion of a cutout for allowing piping, such as, for example a pipeline to extend through the sidewall assembly.

It is important to note that the illustrated embodiment is only a representative embodiment of enclosure 10. All sidewall panel members may be replaced or exchange with any other sidewall panel member. For example, panel members 606*a* and 606*b* can be replaced by panel members 602 or 604. Further, while not shown, a sidewall panel member may be provided with a cutout solely formed through that panel member.

Figure 24:
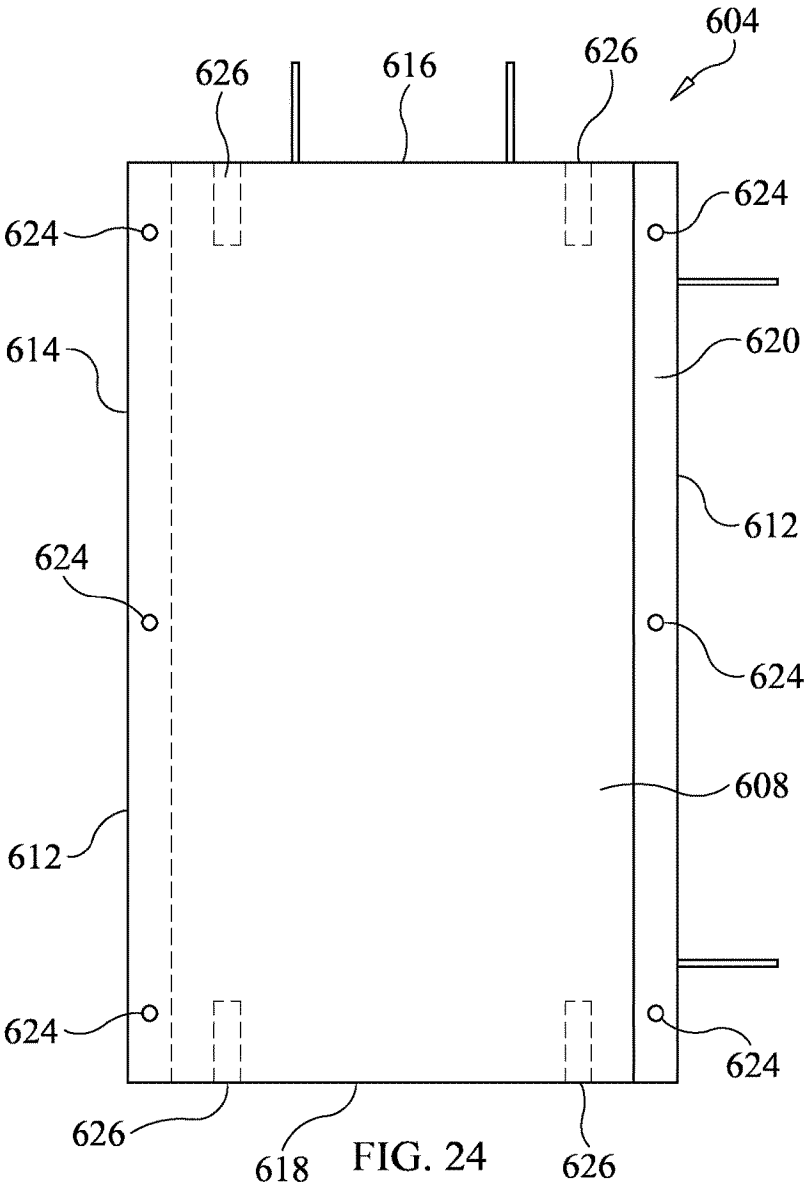
FIG. 24 is an exterior view of one embodiment of a sidewall panel member of the protective enclosure.
Figure 23:
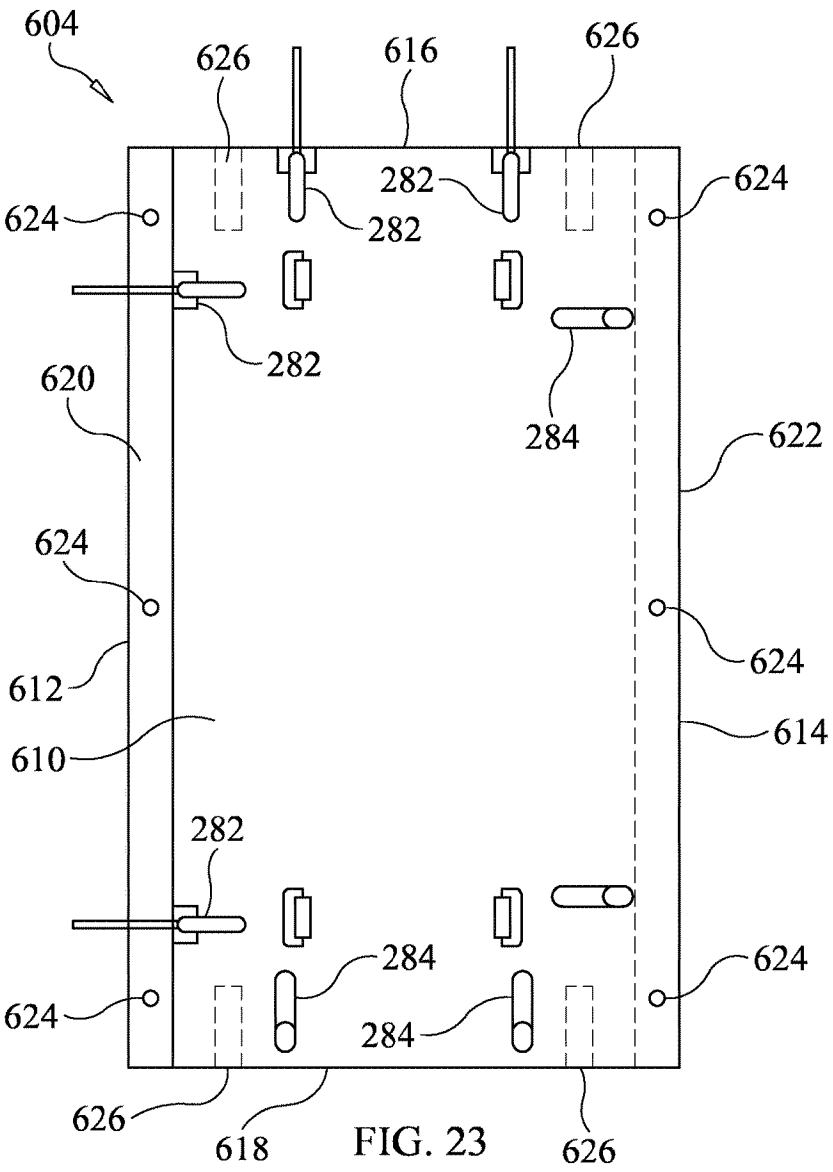
FIG. 23 is an interior view of one embodiment of a sidewall panel member of the protective enclosure.

In FIGS. 23-24, sidewall panel member 602 is shown and is representative of the general construction of each sidewall panel member of the enclosure system, such as, for example sidewall panel members 604 and 606*a*/606*b*. Each sidewall panel member 604 includes a broad exterior side 608, an broad interior side 610 that is spaced from said broad exterior side defining a thickness therebetween, a first edge 612, a second edge 614 opposite said first edge, a third edge 616 substantially perpendicular to and extending between the first and the second edges, a fourth edge 618 opposite to and substantially parallel to the third edge, wherein the distance between the third edge and the fourth edge defines a predetermined height. The first edge 612 has a tongue 620 and the second edge 614 has a groove 622. The tongue and grooves 620 and 622 may include through holes 624 spaced therealong, respectively, for receiving bolts. Each sidewall panel member 604 may also include pin receiving holes 626 that are formed through the third and fourth edges 616 and 618, respectively.

Sidewall panel members 602 that are arranged side-by-side in a juxtaposed coplanar relationship may be connected by the tongue 620 of one panel disposed within the groove 622 of the adjoining panel. The tongue 620 can be secured in the groove 622 by one or more bolts that is passed through cooperative holes 624 formed through the tongue and groove. This assembly is substantially the same as the roof panel members 102 as shown in FIG. 9 and does not require a separate figure here for understanding. Sidewall panel members 602 may be arranged end-to-end to increase the height of the enclosure. Sidewall panel members 602 that are arranged end-to-end in a juxtaposed coplanar relationship can be connected by one or more pins received by cooperating arranged pin receiving holes 626 through edges 618 and 620, respectively. This assembly is substantially the same as the roof panel members 102 as shown in FIG. 10 and does not require a separate figure here for understanding.

Figure 26:
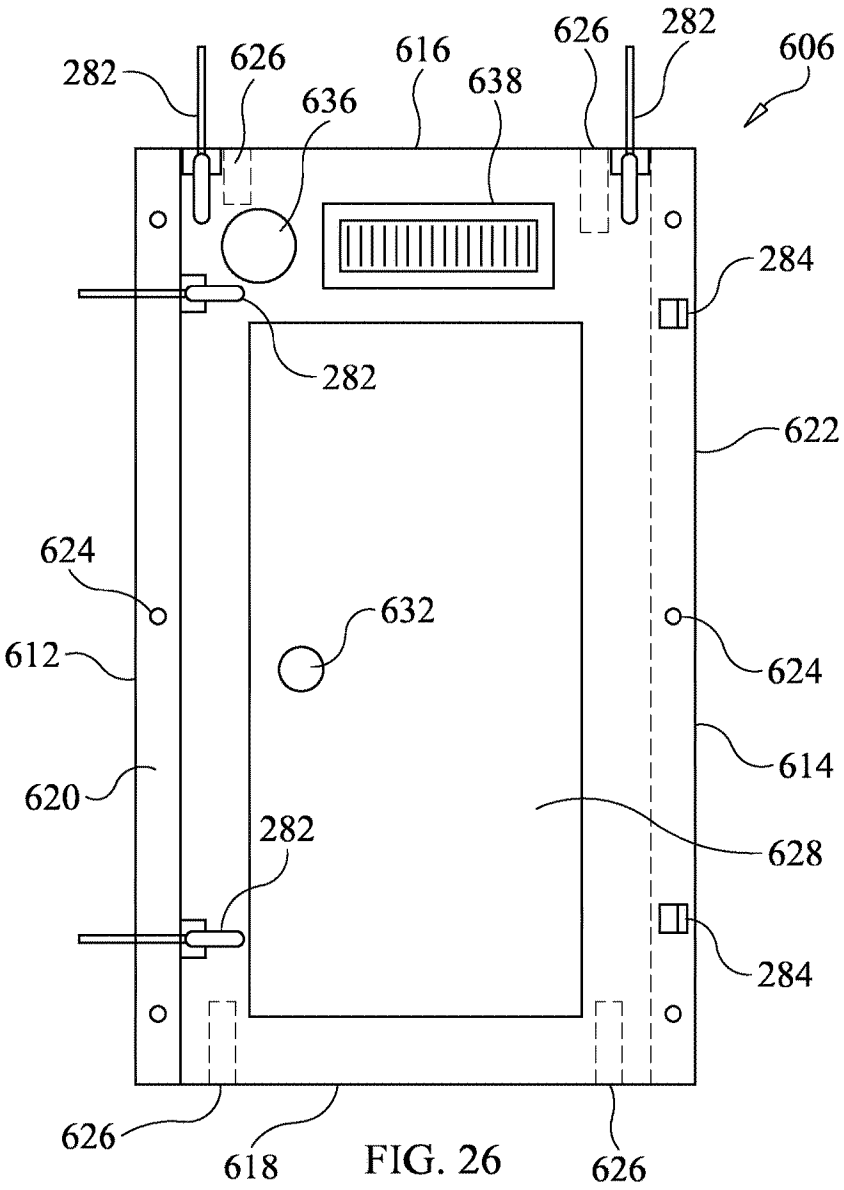
FIG. 26 is an interior view of one embodiment of a sidewall door panel member of the protective enclosure.
Figure 25:
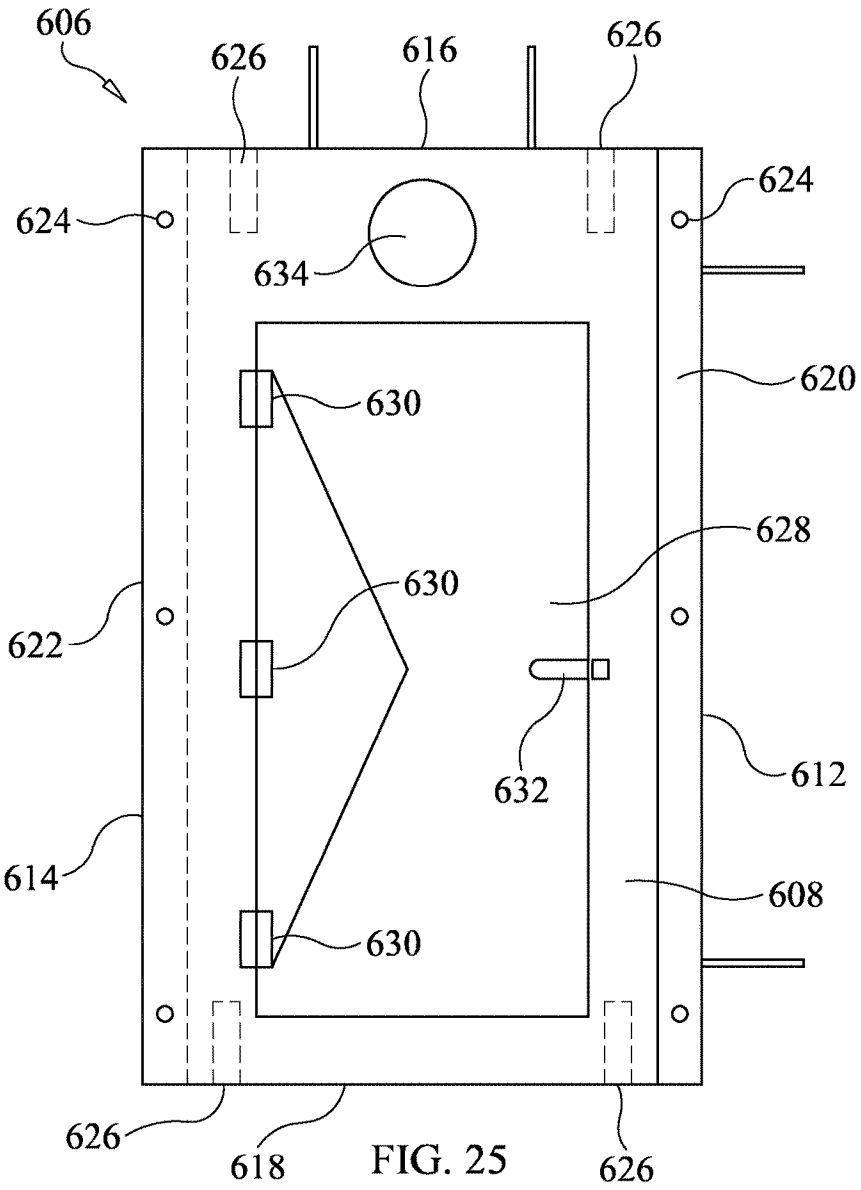
FIG. 25 is an exterior view of one embodiment of a sidewall door panel member of the protective enclosure.

In FIGS. 25 and 26, sidewall door panel members 604 have substantially the same overall construction as sidewall panel members 602 but include additional elements. Panel members 604 have a framed and hung door 628 that allows access to the interior of the enclosure 10. In a preferred embodiment, door 628 has spring-biased hinges 630 that bias the door into the closed position and a latch 632 that is like a walk-in freezer door latch. Panel members 604 further include an exterior light 634 and an interior light 636 for illuminating the area around the door, and which can be LED lights. Panel members 604 may further include a space heater 638 for heating the interior space of the enclosure. The lights 634, 636 and the space heater 638 may be powered by a portable generator not shown. In other embodiment, space heater 638 could be replaced for an air conditioner as desired.

In embodiments, and to satisfy certain regulations, enclosure 10 must have two or more sidewall door panel members 604 to provide two separate ways to enter and exit the enclosure. The door panel members 604 maybe located directly across from one another in opposite sidewall assemblies or can be located at various wall locations as desired.

Figure 29:
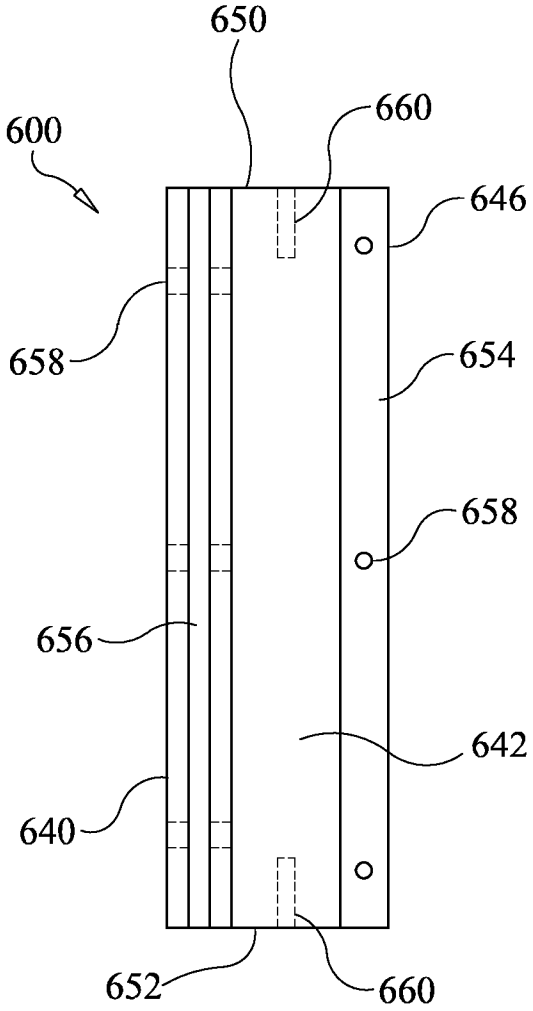
FIG. 29 is an end view of a wall corner connector panel of the protective enclosure.
Figure 28:
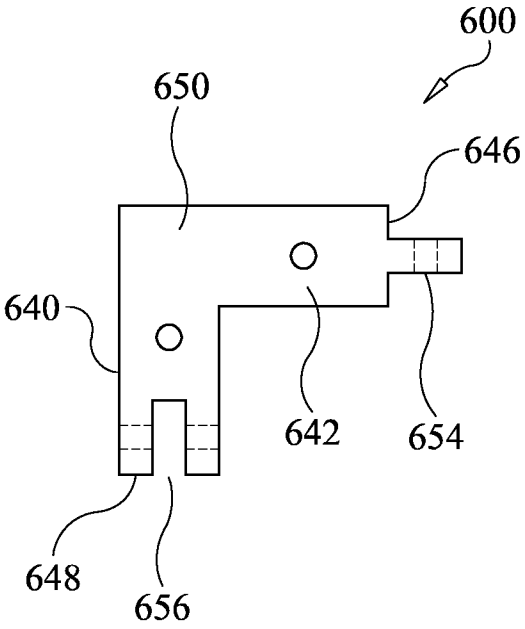
FIG. 28 is a top view of a wall corner connector panel of the protective enclosure.
Figure 27:
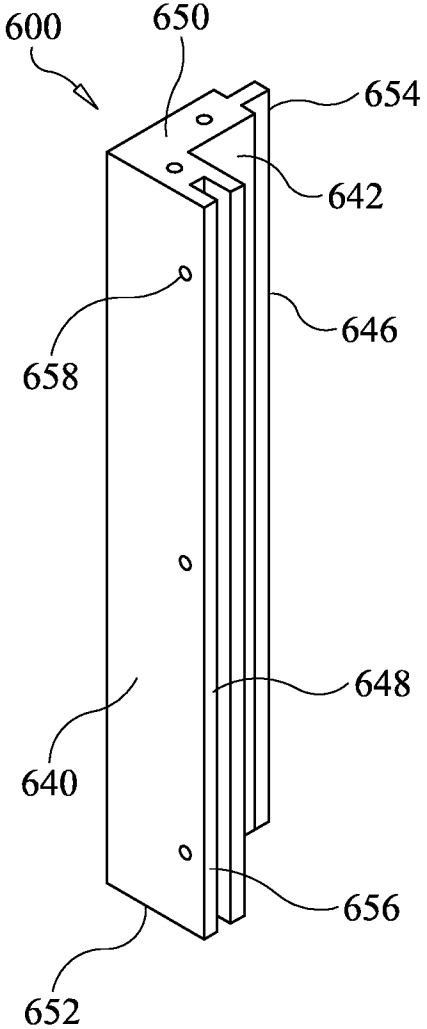
FIG. 27 is a perspective view of a wall corner connector panel of the protective enclosure.

In FIGS. 27-29, wall corner connector panels 600 are generally corner shaped having two vertical planar portions 640 and 642 arranged perpendicular to one another and having a thickness equal to the thickness of the sidewall panel members. Wall corner connector panels further include a first edge 646, a second edge 648 opposite said first edge, a third edge 650 substantially perpendicular to and extending between the first and the second edges, a fourth edge 652 opposite to and substantially parallel to the third edge, wherein the distance between the third edge and the fourth edge defines a predetermined height, equal to the sidewall panel height. The first edge 646 has a tongue 654 and the second edge 648 has a groove 656. The tongue and grooves 654 and 656 may include through holes 658 spaced therealong, respectively, for receiving bolts. Each wall corner connector panels 600 may also include pin receiving holes 660 that are formed through the third and fourth edges 650 and 652, respectively.

Figure 22:
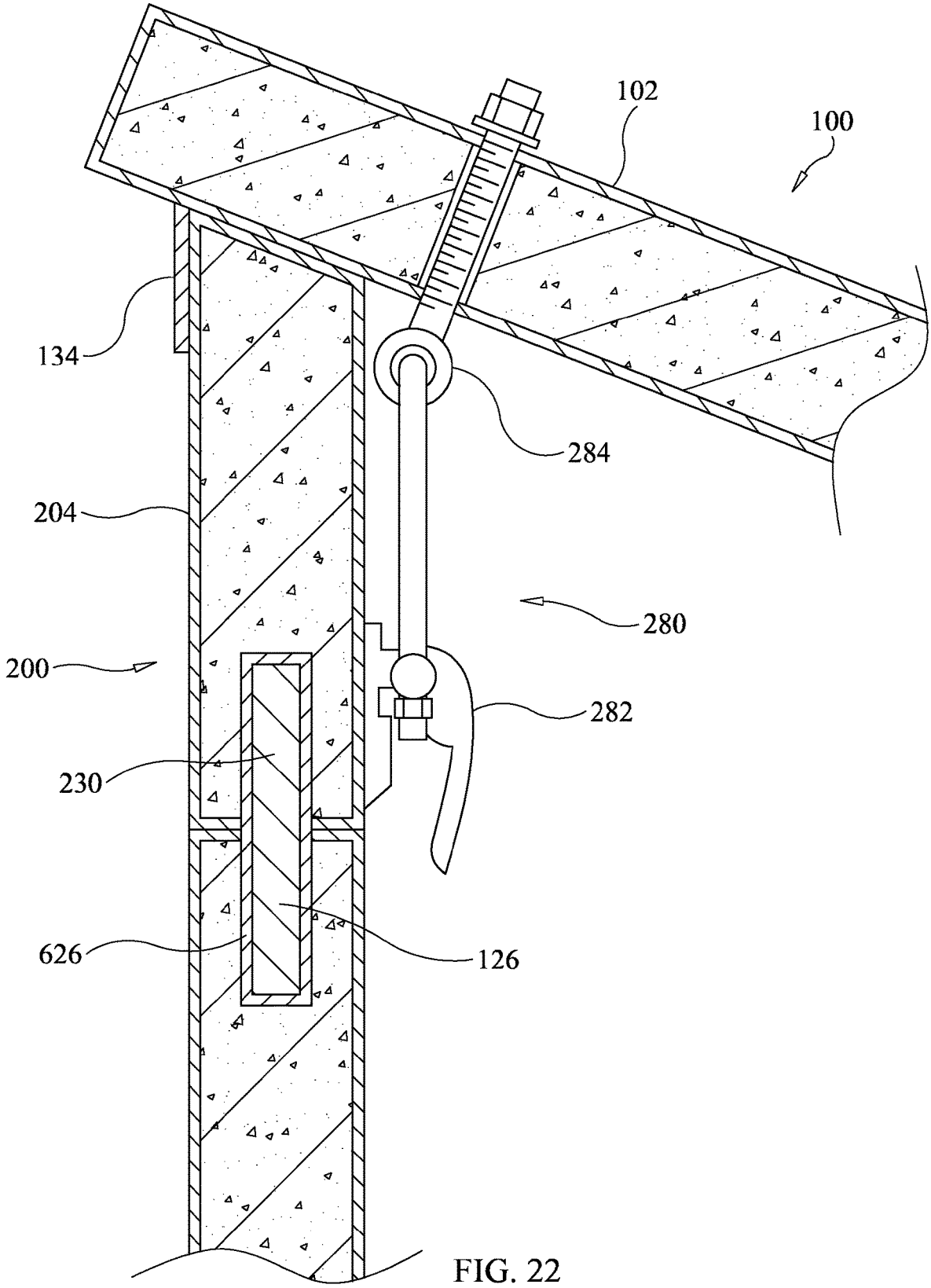
FIG. 22 is a partial cross-sectional view showing an engagement between the roof assembly and the gable assembly.
Figure 30:
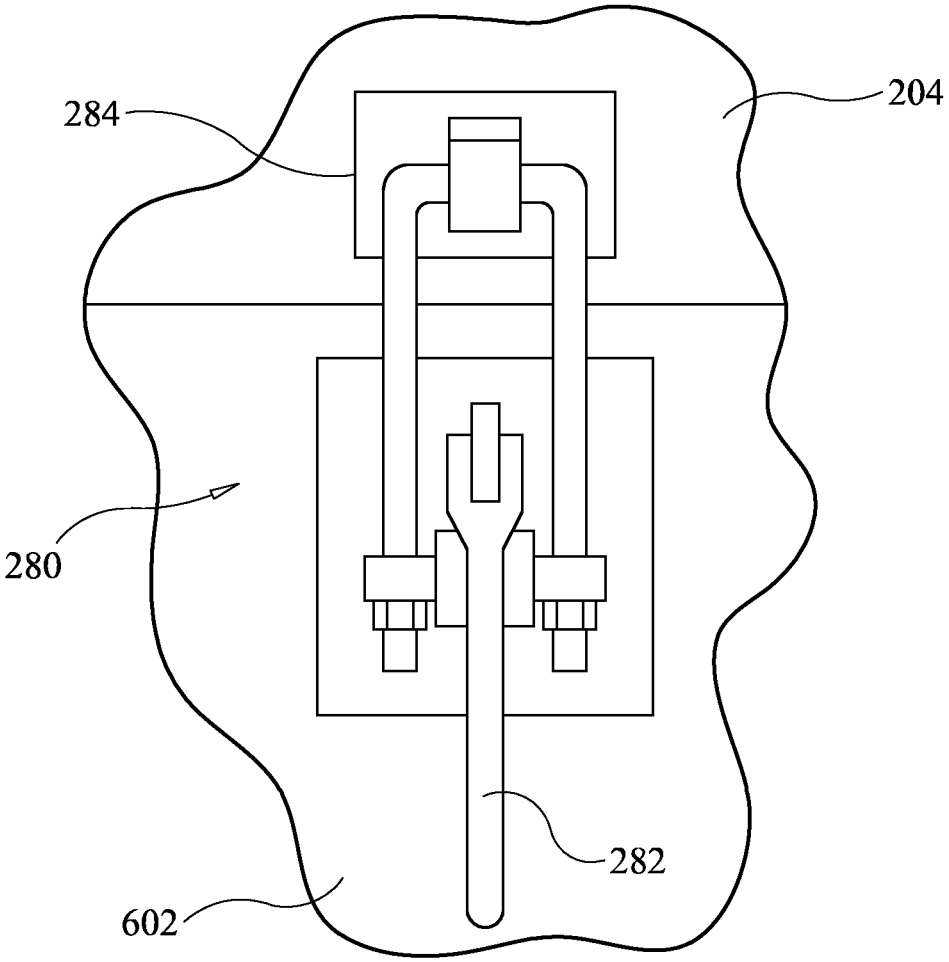
FIG. 30 is a view of a sidewall assembly to gable assembly securing member.

A plurality of sidewall assembly to gable assembly securing members are arranged to secure each sidewall assembly of the plurality of sidewall assemblies 300, 400, and 500 to the gable assembly in such a manner to prevent separation in a plurality of directions. In the preferred embodiment the securing members are toggle latches 280 there were described above, except member 284 is a J-hook as opposed to an eyebolt. One such securing member 280 is shown in FIG. 30, which illustrates a sidewall panel member 602 secured to a gable sidewall panel 204. Further, as shown in FIG. 22, a sidewall panel member 602 is shown further secured to a gable sidewall panel 204 with a pin 126 disposed in respective pin receiving holes 626 and 230. The remaining sidewall panel members are secured to the remaining panel members of the gable assembly with the same pin-in-hole connection.

Figure 31:
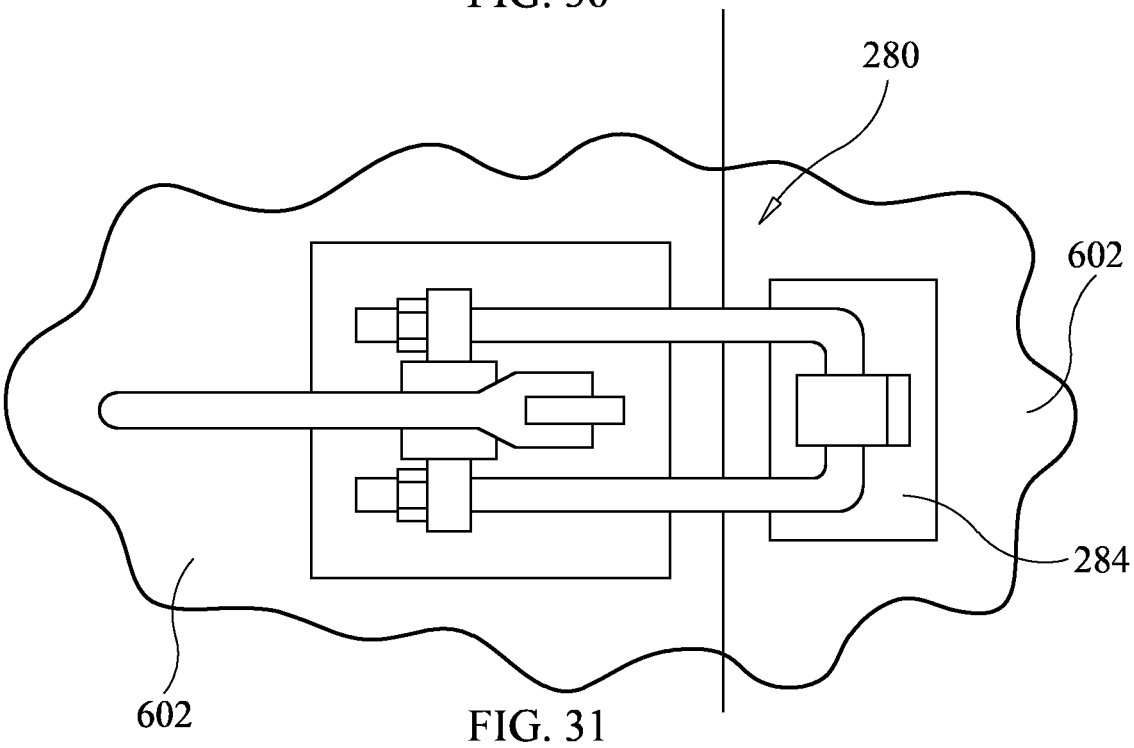
FIG. 31 is a view of a of sidewall-to-sidewall securing member.
Figure 32:
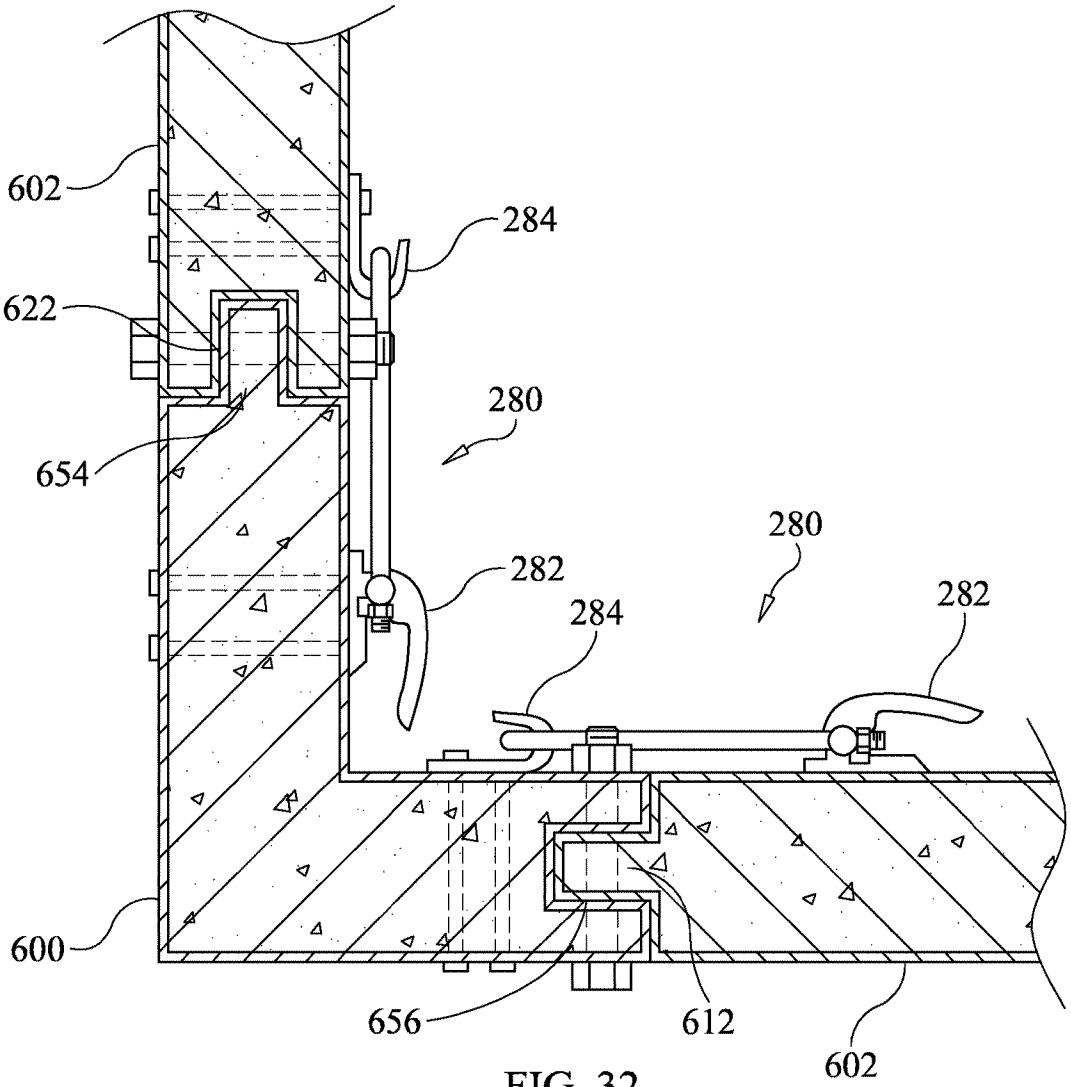
FIG. 32 is a cross-sectional view showing a wall corner connector panel connecting adjoining edges of two sidewall panel members.

A plurality of sidewall-to-sidewall securing members are arranged to secure juxtaposed sidewall panels or sidewall panels juxtaposed to wall corner connector panels in such a manner to prevent separation in a plurality of directions. In the preferred embodiment the securing members are toggle latches 280 there were described above, except member 284 is a J-hook as opposed to an eyebolt. One such securing member 280 is shown in FIG. 31, which illustrates a sidewall panel member 602 secured to a juxtaposed sidewall panel 602. In FIG. 32 there is shown a cross-section of two sidewall panel members 602 of separate different sidewall assemblies 300 and 400, for example, connected by a wall corner connector panel 600.

Figure 33:
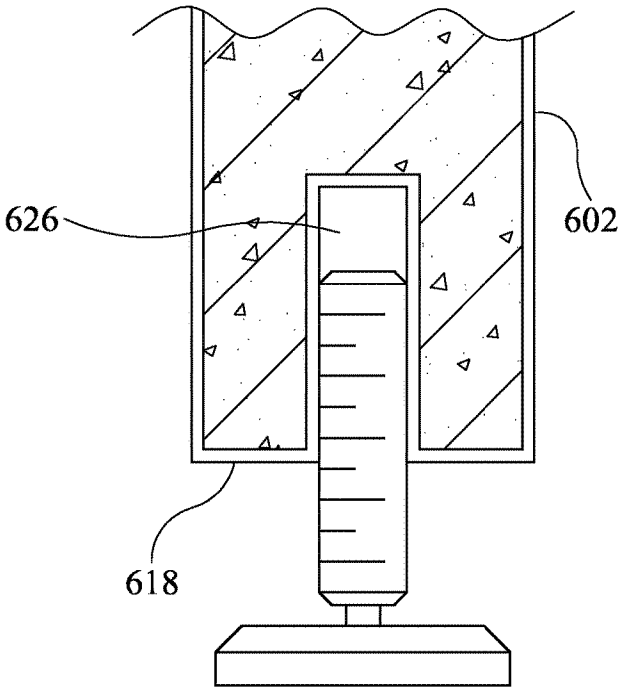
FIG. 33 is a cross-sectional view showing an adjustable foot located in a pin receiving hole through a bottom edge of a sidewall panel member.

In FIG. 33 there is shown a cross-section of a bottom of a sidewall panel member 602 showing that each sidewall panel member may have an adjustable foot 662 disposed in one or more pin holes 626 formed through edge 618 for leveling each the panel member. The corner connector panel members can also include the adjustable foot.

Figure 34:
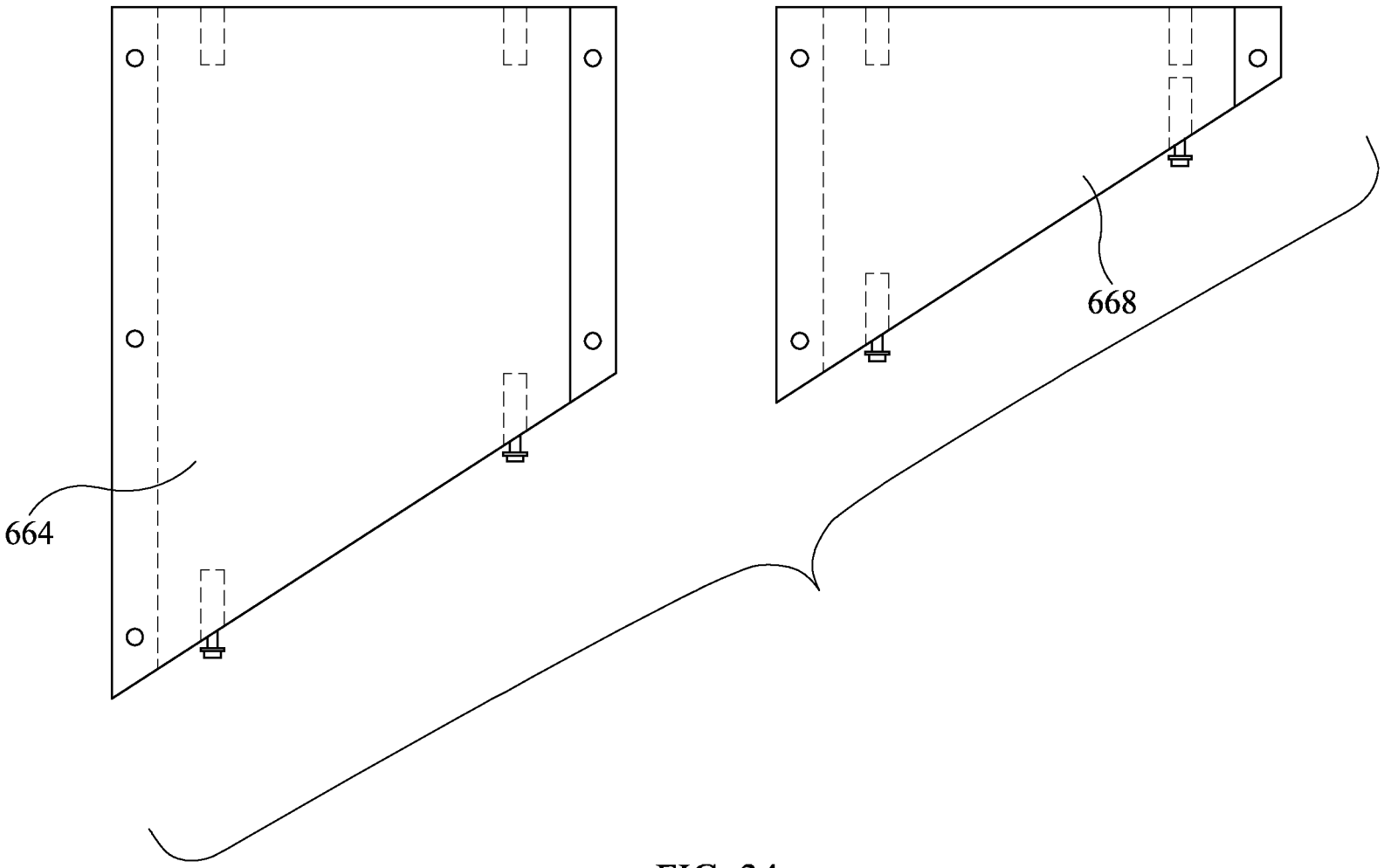
FIG. 34 is a side view of grade slope sidewall panel members.

In FIG. 34 there is shown sidewall panel members 664 and 668 that are used when the enclosure 10 is situated on a steep ground grade. Panel members 664 and 668 have a similar construction to that of sidewall panel members 602, except the fourth edge 670 tapers between the first and second edges 612 and 614. The angle of the taper can be customized for grades upon which the enclosure 10 is to be placed.

Further, while not shown, all or some of the panel members comprising the roof assembly 100, the gable assembly 200, and the sidewall assemblies 300, 400, and 500 can have rings, such as D-rings through which steel cable can be threaded and looped around a the equipment located within the enclosure to further anchor the enclosure against wind.

Figure 36:
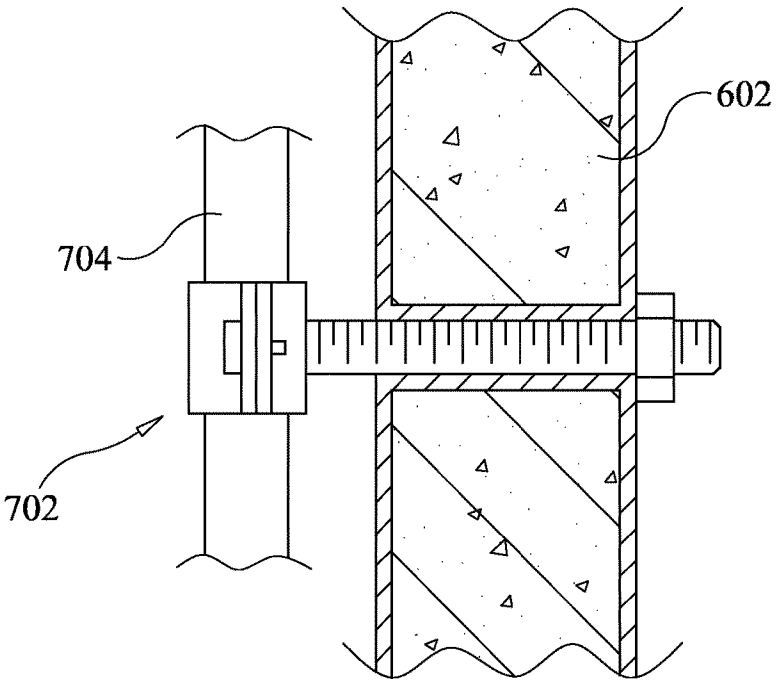
FIG. 36 is an illustrative, cross-section view showing a representative clamp for attaching a panel member to a scaffold.
Figure 35:
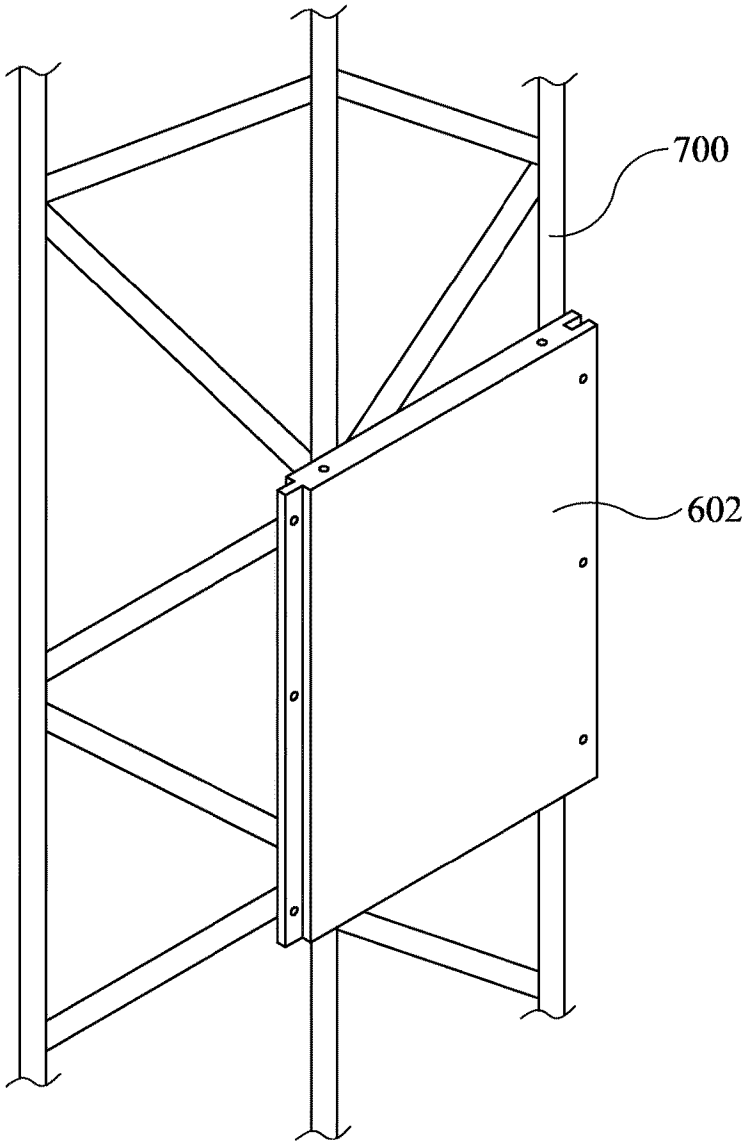
FIG. 35 is an illustrative perspective view showing a sidewall panel member attached to a scaffold.

Additionally, as representatively shown in FIGS. 35 and 36, any or all of the panel members comprising the roof assembly 100, the gable assembly 200, and the sidewall assemblies 300, 400, and 500 can be configured to attached to a scaffolding structure. For example, as representatively shown, sidewall panel member 602 is removably attached to scaffold 700 by panel to scaffold attaching members. The scaffolding attaching members are representatively shown as clamps, such as a bar clamp 702 that secures to a structural member 704 of the scaffold to secure the panel 602 to the scaffold. While only one clamp 702 is shown, many clamps may be used as desired to attach a panel member to the scaffold.

Figure 37:
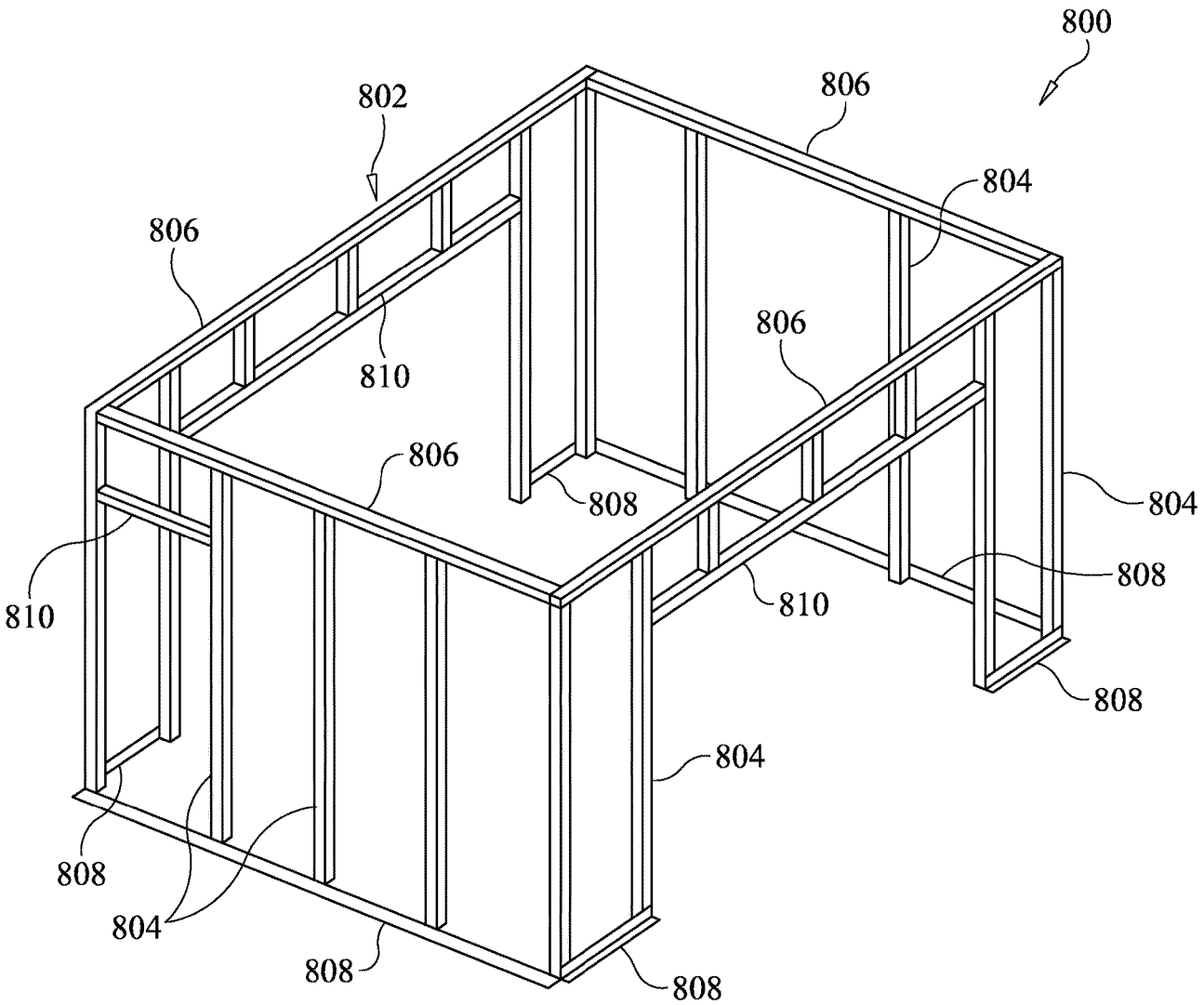
FIG. 37 is an illustrative, perspective view of a wall frame for an enclosure constructed in accordance with an embodiment of the invention.

In FIG. 37 there is shown another embodiment 800 of the invention. In this embodiment 800, a frame 802 is provided comprising a plurality of upright stud members 804 of metal squaring tubing that are connected along their tops by angle-iron 806 and along their bottoms by angle-iron 808. The purpose of the frame 802 is to provide a modular, easily constructed support structure upon which the insulated panels are attached and supported. Further shown, headers 810 are used between stud members 804 to support openings for doors. It is important note the frame 802 is not limited to configuration shown herein. It can be constructed in a myriad of configurations to meet the desired application.

Figure 38:
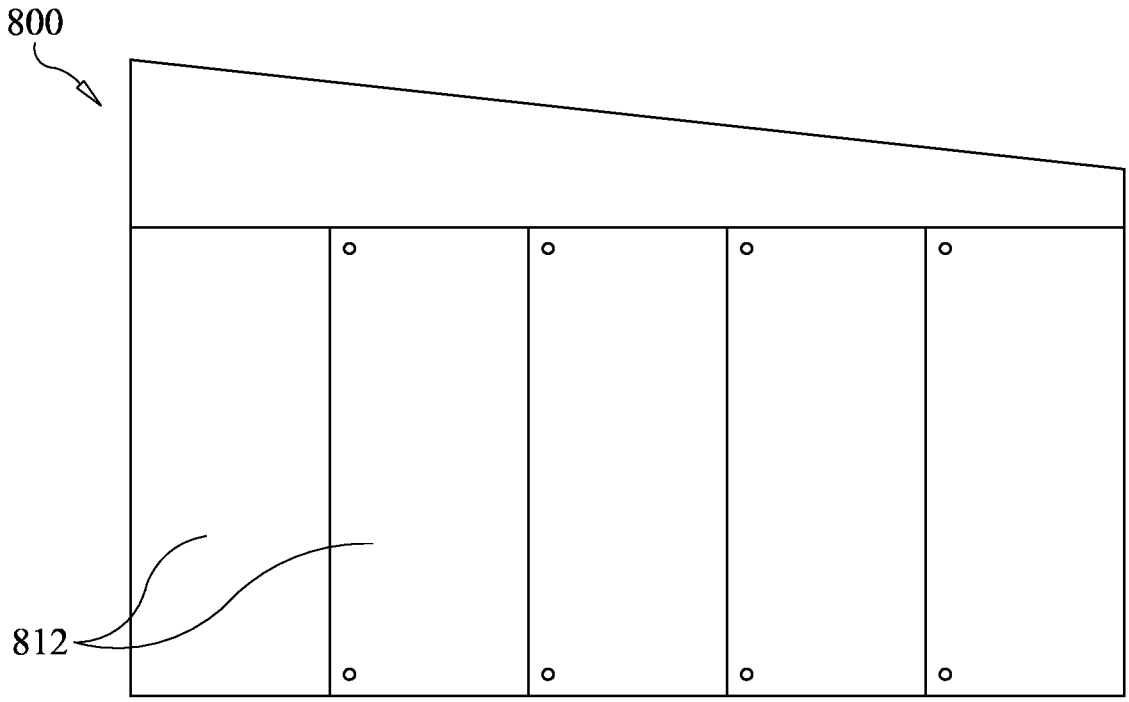
FIG. 38 is an illustrative, elevation view of an enclosure having a lean-to roof constructed in accordance with an embodiment of the invention.
Figure 39:
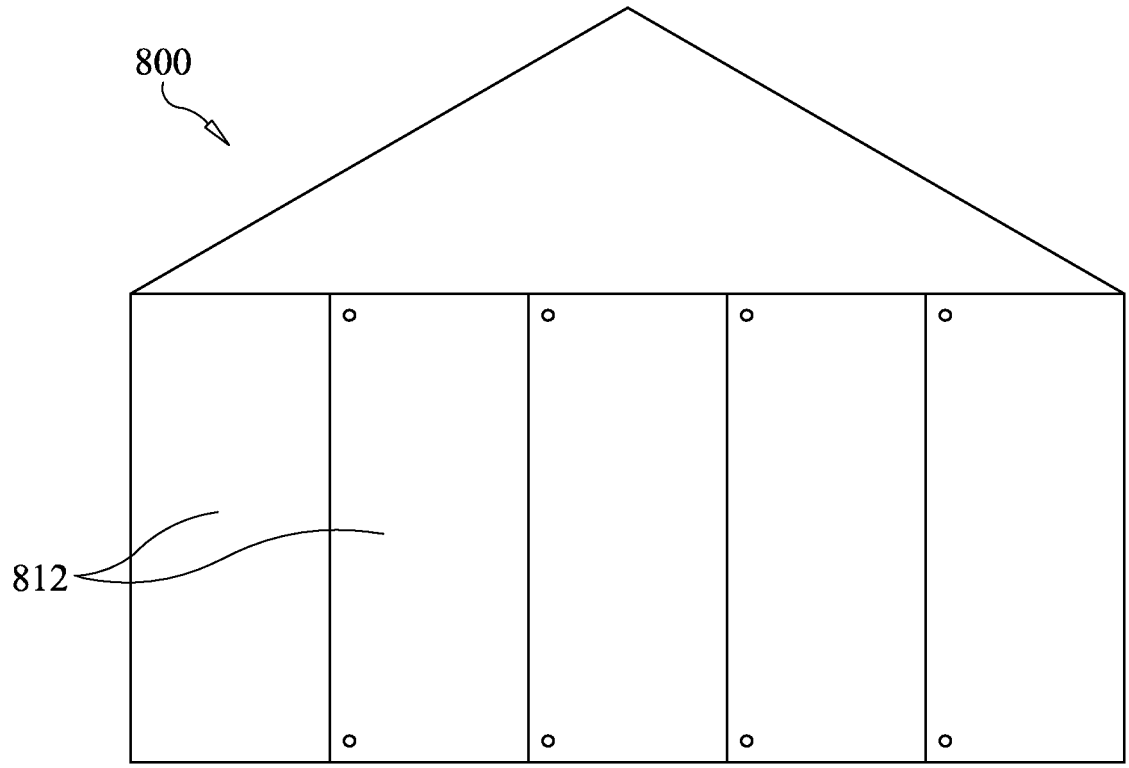
FIG. 39 is an illustrative, elevation view of an enclosure having a gable roof constructed in accordance with an embodiment of the invention.

In FIG. 38, embodiment 800 is representatively shown constructed having a lean-to roof. In FIG. 39, embodiment 800 is representatively shown constructed having a cable roof. Further shown are insulated panel members 812 connected side-by-side to form wall assemblies that are supported upon the frame (not shown here). The insulated panel members 812 can have the same or a similar construction to any of the insulated panel members described herein.

Figure 40:
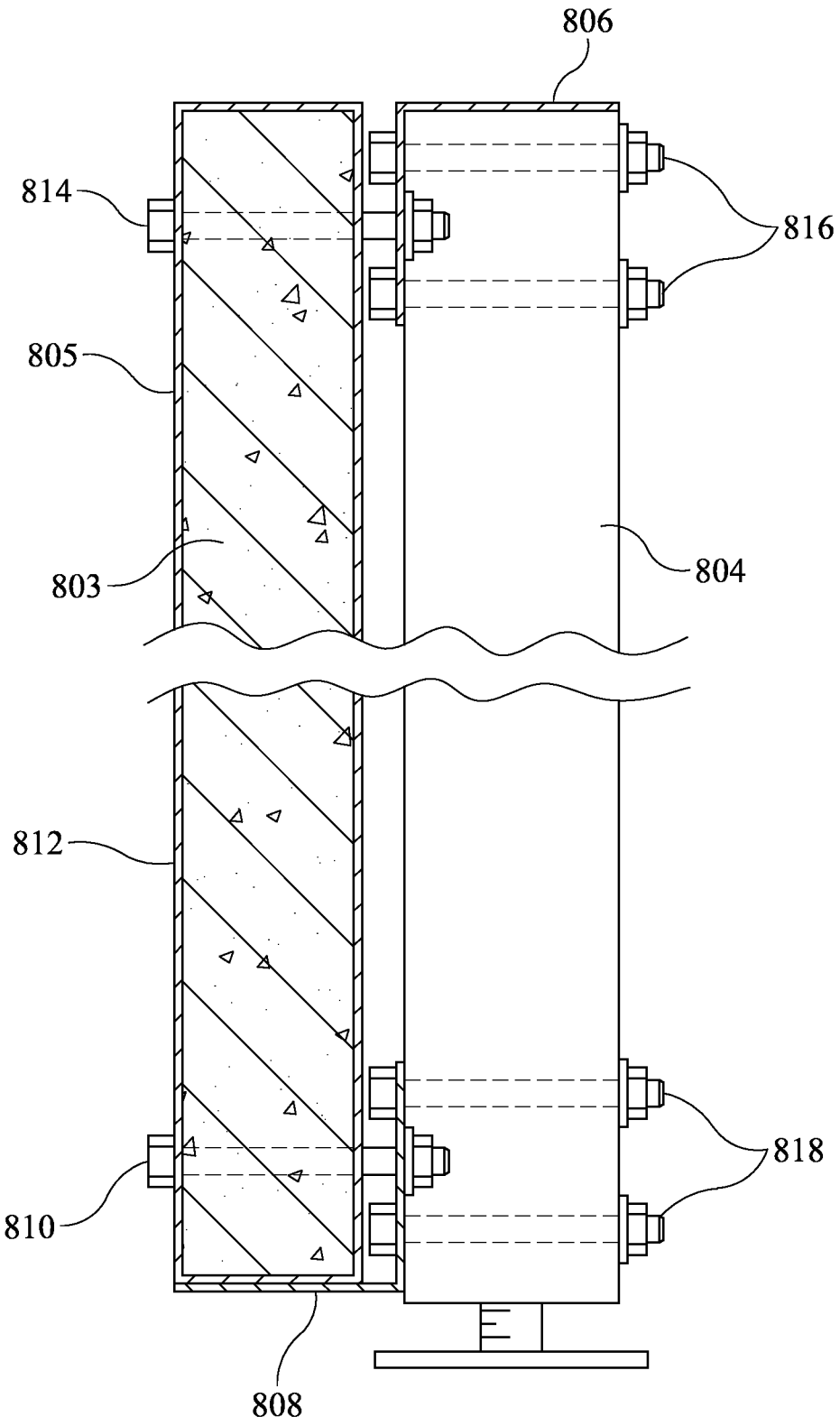
FIG. 40 is an illustrative, cross-sectional view, showing an insulated panel of a wall assembly secured and supported to a wall frame constructed in accordance with an embodiment of the invention.

FIG. 40 is a cross-sectional view, showing an insulated panel 812 of a wall of embodiment 800 secured and supported to the frame 802. Particularly, the panel 812 is supported at its bottom upon angle-iron 808 and secured thereto by threaded fastener 810. The top of the insulated panel is secured to angle-iron 806 by threaded fastener 814. As further shown, angle-iron 806 is attached to upright stud member 804 by threaded fasteners 816, and the angle-iron 808 is likewise attached to the upright stud member 804 by fasteners 818. This construction is exemplary of how all the insulated panels 812, forming walls of the embodiment 800 are secured to the frame 802. Further shown here is the insulated core 803 of the panel 812 and its encapsulated skin or cladding 805.

Figure 41:
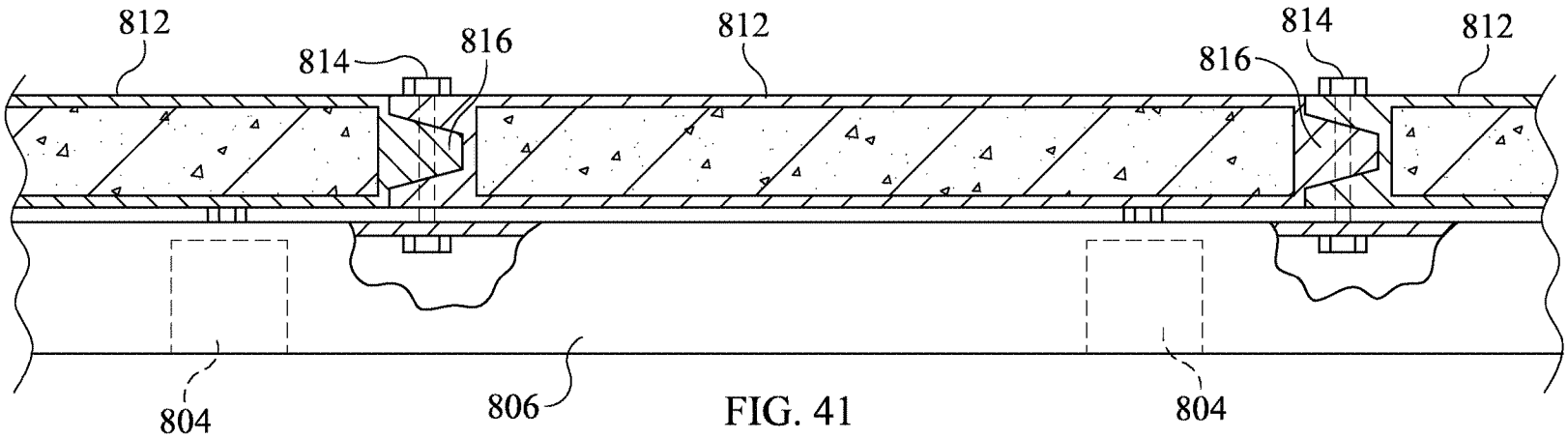
FIG. 41 is an illustrative, top cross-sectional view showing a plurality of wall panel members connected together at their adjoining ends by a tongue-and-grove coupling and secured together by fasteners, which also secure the panel members to an angle-iron member of a wall frame constructed in accordance with an embodiment of the invention.

In FIG. 41 there is shown top cross-sectional view illustrating a plurality of wall panel members 812 connected together at their adjoining ends by a tongue-and-grove coupling 816 and secured together by fasteners 814, which also secure the panel members to the angle-iron member 806 that secures the tops of vertical stud members 804 together.

Figure 42:
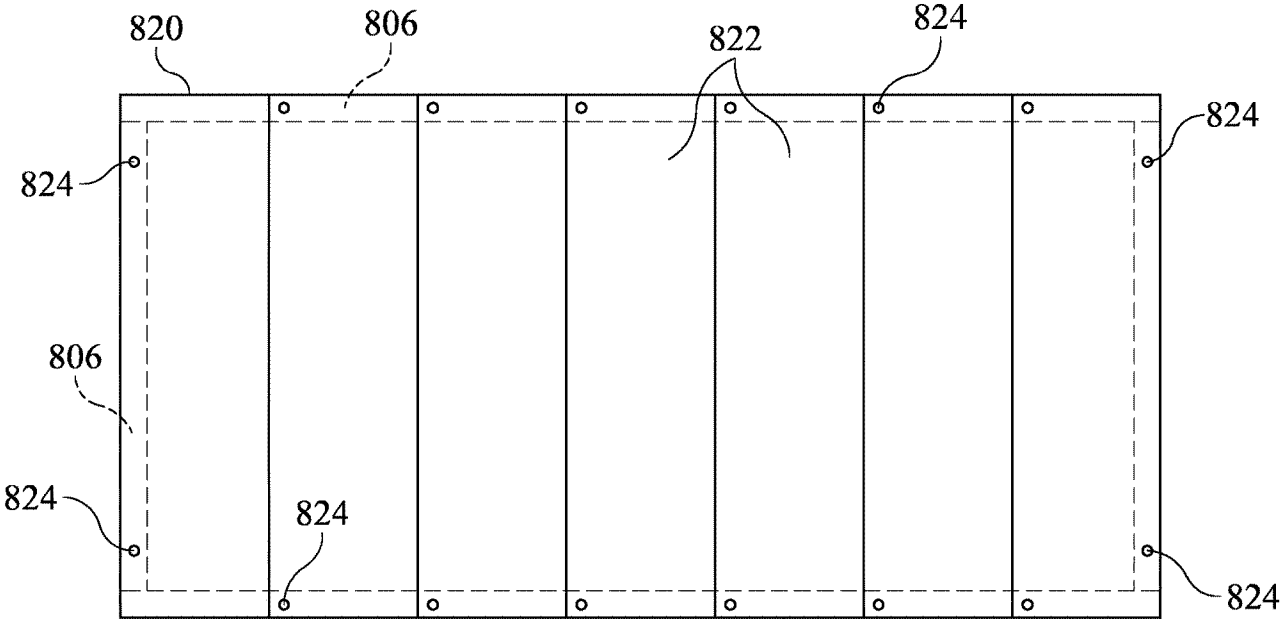
FIG. 42 is an illustrative, top plane view of a roof assembly that is comprised of a plurality of insulated roof panel members that are connected together side-by-side by a tongue-and-grove coupling, shown attached to a wall frame, in accordance with an embodiment of the invention.

In FIG. 42, there is shown a top view of a roof assembly 820 that is comprised of a plurality of insulated roof panel members 822 that are connected together side-by-side, similar to the having a similar construction to any of the forgoing insulated panel members described herein. The roof assembly, as shown here, is attached to the top of the frame along angle-iron members 806 by threaded fasteners 824. Threaded fasteners 824 can also serve to connect the panel members together at the tongue-and-grove coupling therebetween.

Figure 43:
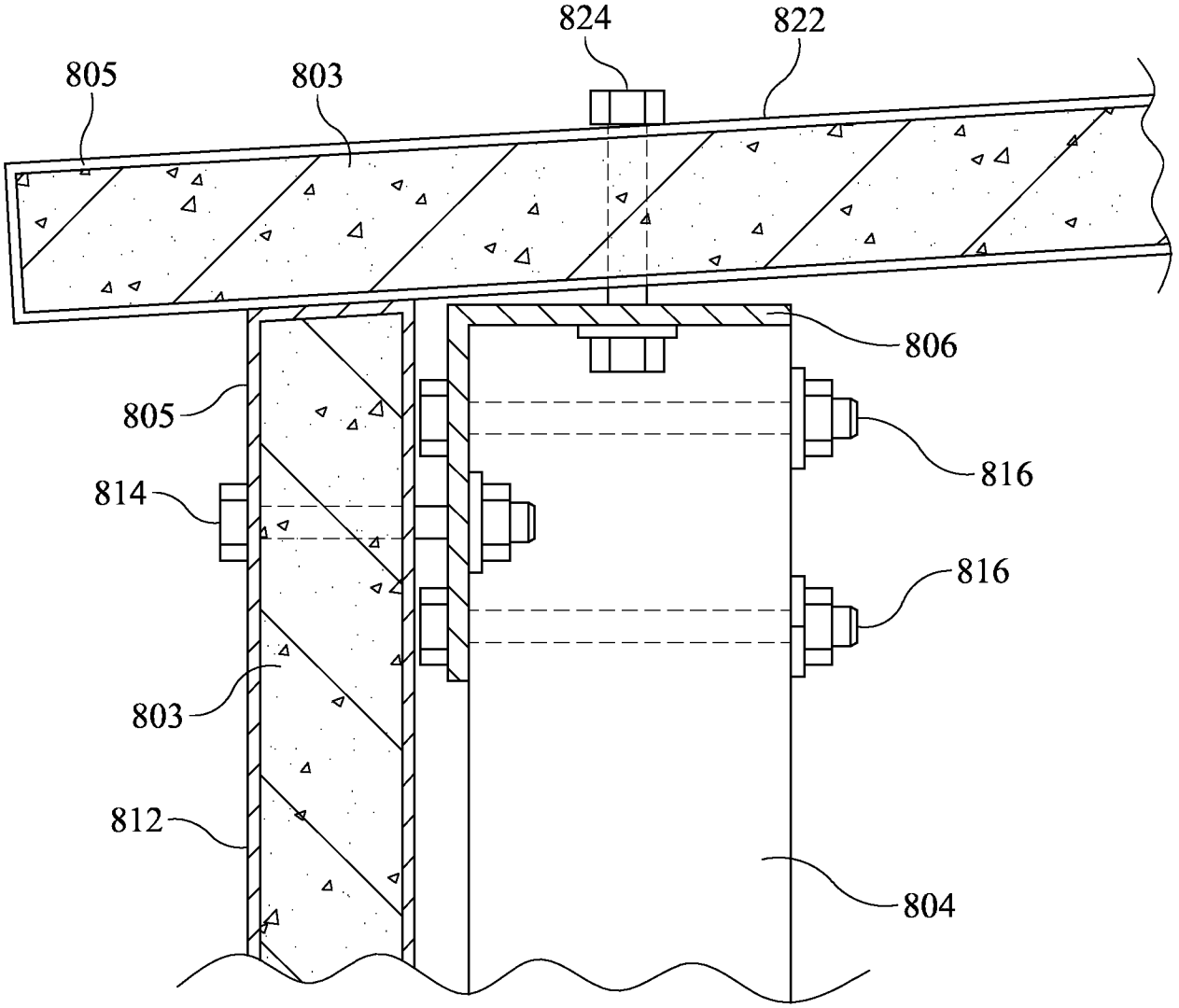
FIG. 43 is an illustrative, a cross-sectional view illustrating a connection between a roof panel member and an angle-iron member of a wall frame constructed in accordance with an embodiment of the invention.

In FIG. 43, there is shown a cross-sectional view illustrating a connection between a roof panel member 822 and angle-iron 806 of frame 802. As shown, threaded fastener 824 secures the panel member 822 to the angle-iron 806. Further seen is the coupling of wall panel member 812 to angle-iron 806 by fastener 814, and the angle-iron being connected to stud member 804 by fasteners 816.

Figure 44:
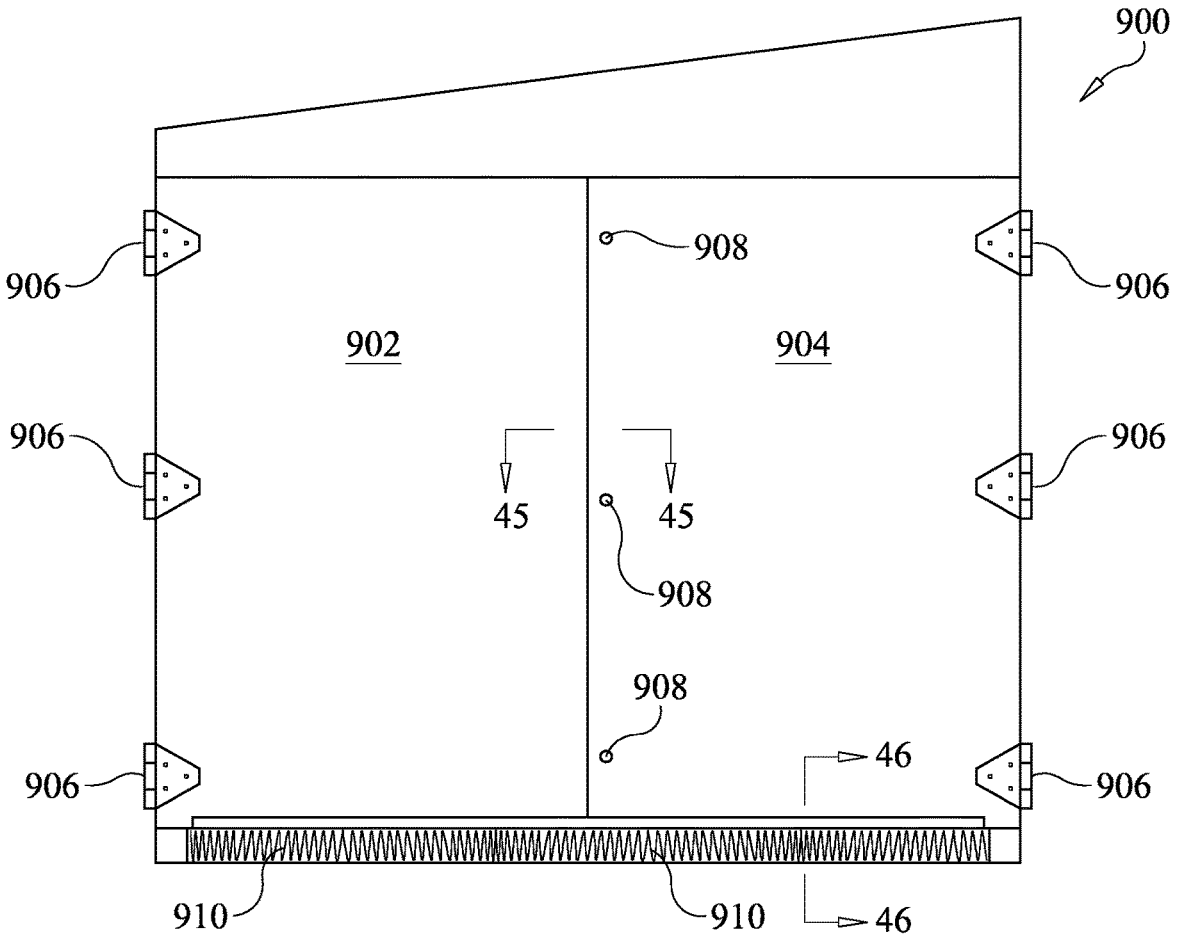
FIG. 44 is an illustrative, elevational view of an exemplary door assembly of an end of an enclosure constructed in accordance with an embodiment of the invention.
Figure 45:
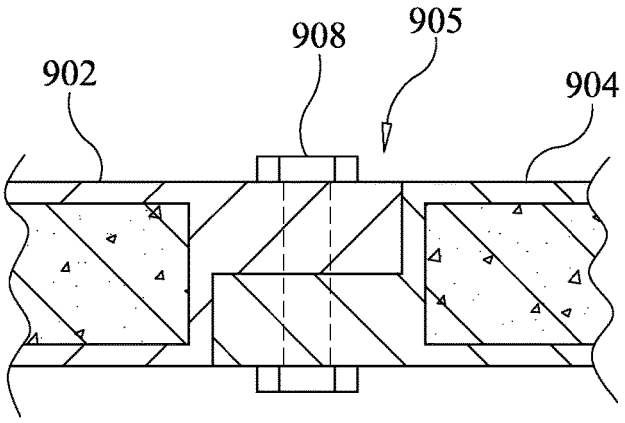
FIG. 45 is an illustrative, cross-sectional view taken along line 45-45 in FIG. 44, showing a lap joint between the door assembly, in accordance with an embodiment of the invention.
Figure 46:
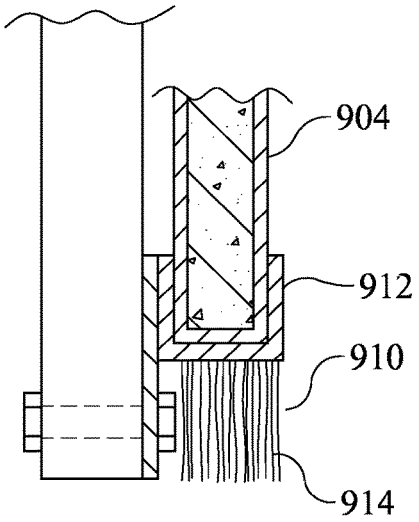
FIG. 46 is an illustrative, cross-sectional view taken along line 46-46 in FIG. 44, showing a bristle-brush door seal.

In FIG. 44, there is shown an elevational view of an exemplary door assembly 900 of a side and particular an end of an enclosure formed by any of the constructions describe herein. Particularly, door assembly 900 includes a pair of door panels 902 and 904, each having a construction like the insulated wall panel members disclosed herein. Both door panels 902 and 904 are attached by hinges 906 to the enclosure to permit the doors to open outwardly to allow for easy replacement of equipment being protected inside the enclosure. In an embodiment, the inward vertical edges of the door panels 902 and 904 have an overlap joint construction 905, best seen in FIG. 45, to provide sealing contact between the doors when closed. Further as shown, the doors may be secured in the closed by a plurality of threaded fasteners 908. Also, as further shown, the bottom of each door is fitted with a bristle-brush like seal members 910 to allow discharge water pipe out of the enclosure. As best seen in FIG. 46, the seal members comprise a flexible, rubber U-shaped trim 912 that is secured to the bottom of each door with the bristles 914 extending downward from the trim.

Figure 47:
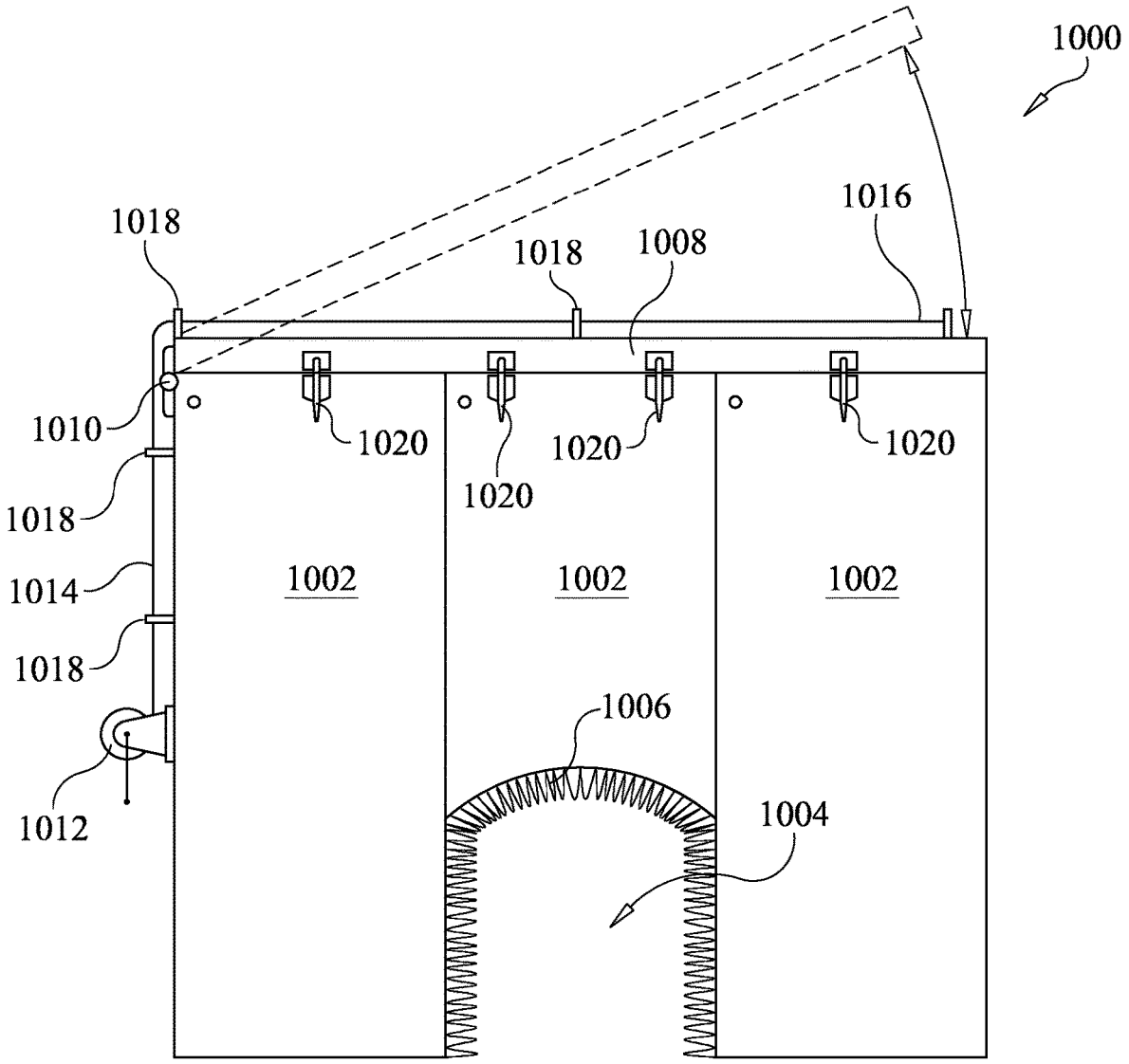
FIG. 47 is an illustrative, elevational view of a wall assembly of an end wall of an enclosure, and further shown is a raisable roof assembly, constructed in accordance with an embodiment of the invention.

In FIG. 47, there is shown an elevational view of a wall assembly 1000 of an end wall of enclosure formed by any of the constructions describe herein. Wall assembly 1000 is like wall assembly 300 discussed herein above and comprises a plurality of insulated wall panels 1002 connected to one another. Wall panels 1002 can take on the construction of any insulated panel discussed herein. Further, like wall assembly 300, wall assembly 1000 includes a pipeline opening 1004 that has a bristle-brush seal 1006 around the opening to seal against a pipe extending through the opening. The bristle-brush seal 1006 has a similar construction as the foregoing describe seal 910. Additionally, while the wall assembly 1000 is shown comprising three connected wall panel members, it could be constructed of a single wall panel.

With continued reference to FIG. 47, the roof 1008, constructed in accordance with any roof assembly described herein, is pivotally connected to the enclosure by a plurality of hinges 1010 such that the roof can 1008 can be rotated from a closed position wherein the top of the enclosure is closed to an open position wherein the top of the enclosure is open. The opening roof 1008 can allow servicing of equipment enclosed within the enclosure, for example to remove a pipeline valve or other equipment. As further shown, the roof 1008 can be raised from the lowered, closed position, to an open position by a winch and cable system, including a winch 1012 and cable 1014 wound on the winch and connected at the opposite end 1016 to the roof. The cable 1014 can be run or strung through eyelets 1018 to guide the cable is it is run in and out.

With continued reference to FIG. 47, the roof 1008 can be locked down in the closed position by one or more toggle clamps 1020, that are like toggle clamps 280 described herein above.

Figure 48:
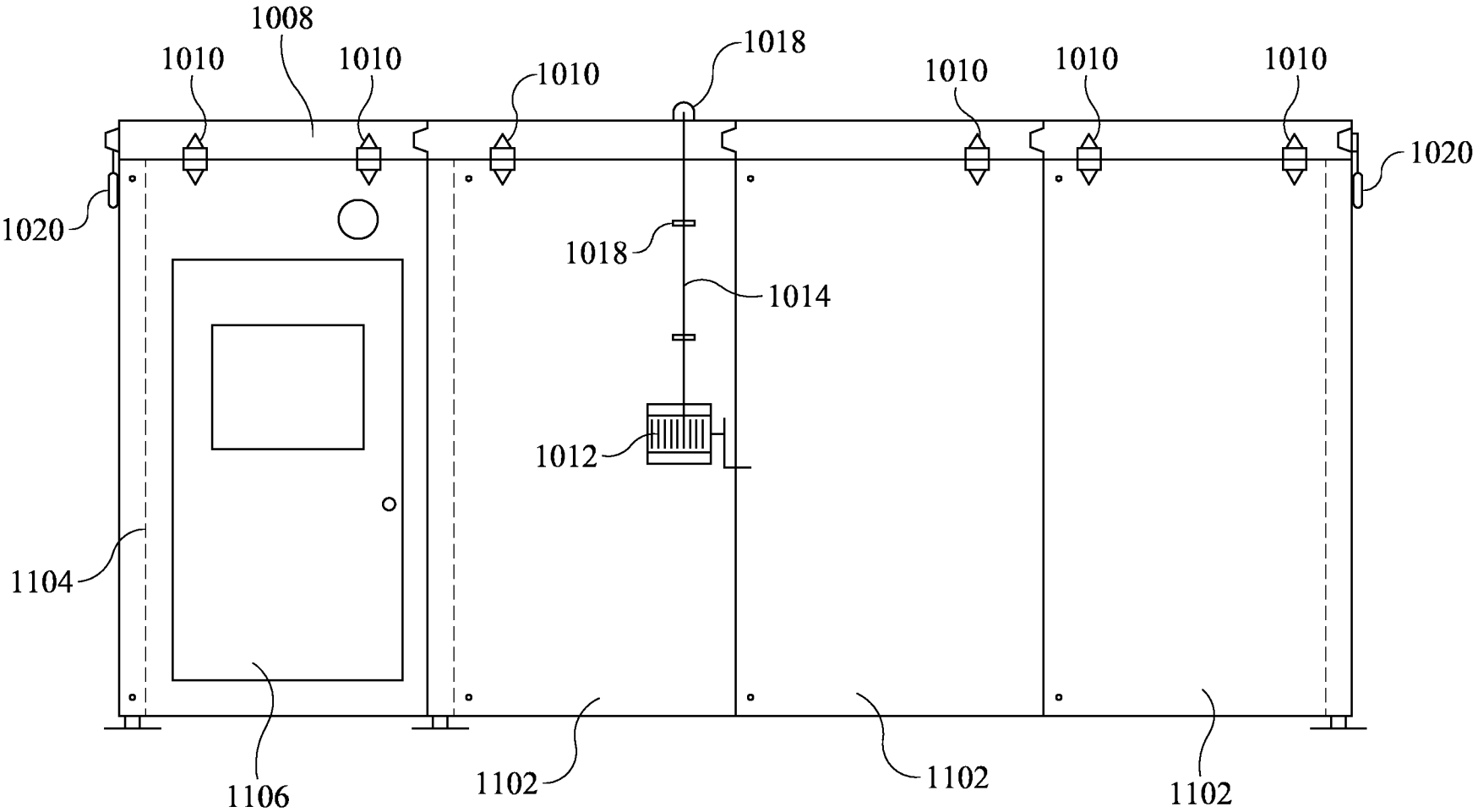
FIG. 48 is an illustrative, elevational view of a wall assembly of a side wall of enclosure, and further shown is a raisable roof assembly, constructed in accordance with an embodiment of the invention.

In FIG. 48, there is shown an elevational view of a wall assembly 1100 of a side wall of enclosure formed by any of the constructions describe herein. Wall assembly 1100 is like wall assembly 400 discussed herein above and comprises a plurality of insulated wall panels 1102 connected to one another. Wall panels 1102 can take on the construction of any insulated panel discussed herein. Like wall assembly 400, wall assembly 1100 includes a wall panel 1104 having a door 1106 for entering the enclosure and a light 1108 for lighting the door. Roof 1008 is further shown connected to wall assembly 1100 by hinges 1010. Winch 1012, cable 1014, and eyelets 1018 are also shown.

Figure 49:
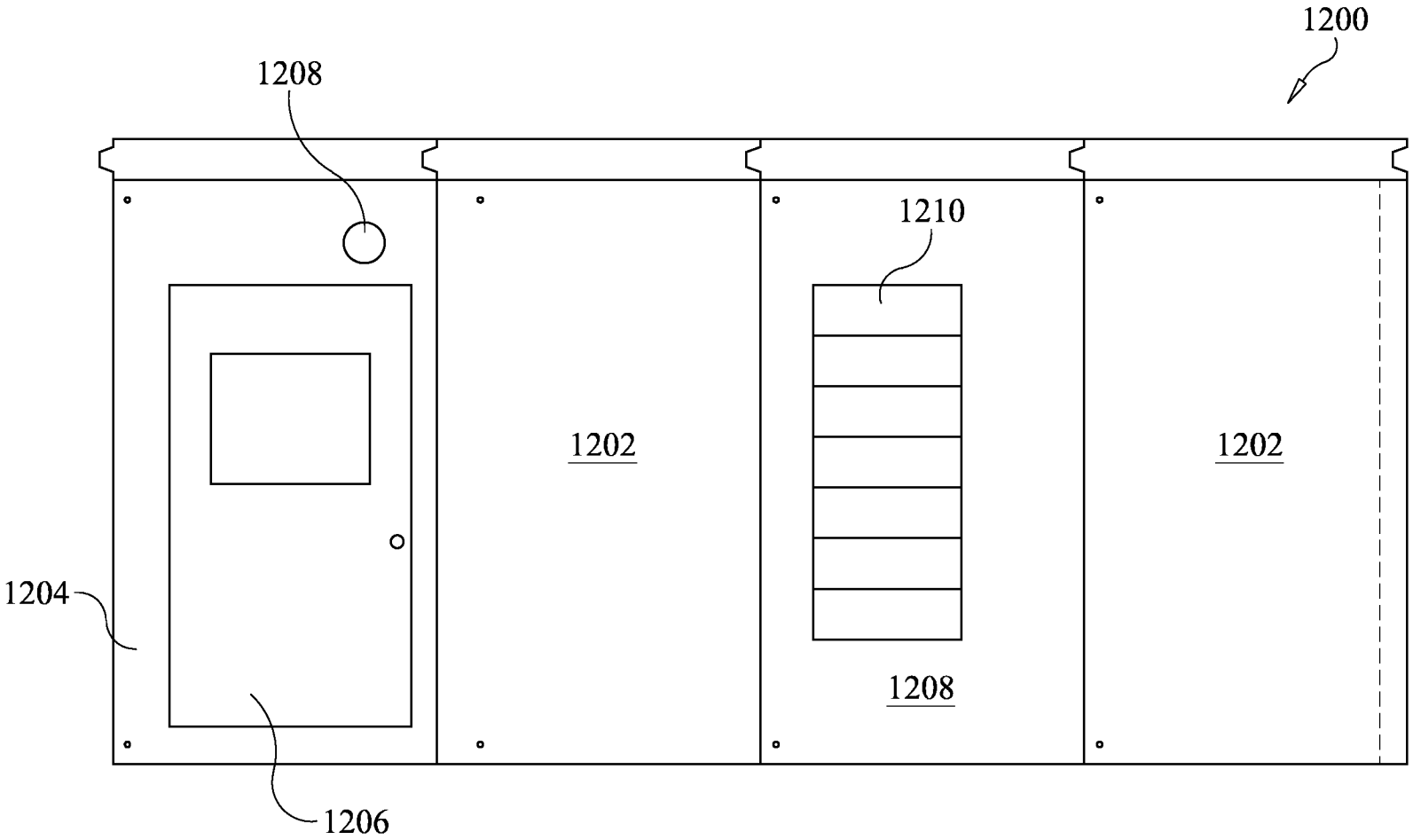
FIG. 49 is an illustrative, elevational view of a wall assembly of a side wall of enclosure constructed in accordance with an embodiment of the invention.

In FIG. 49, there is shown an elevational view of a wall assembly 1200 of a side wall of enclosure formed by any of the constructions describe herein. Wall assembly 1200 is like wall assembly 500 discussed herein above and comprises a plurality of insulated wall panels 1202 connected to one another. Wall panels 1202 can take on the construction of any insulated panel discussed herein. Like wall assembly 500, wall assembly 1200 includes a wall panel 1204 having a door 1206 for entering the enclosure and a light 1208 for lighting the door. Further, wall assembly 1200 can be fitted with a wall panel 1208 having a vent louver 1210. The louver 1210 is built into the wall panel to allow cold air into the enclosure to prevent dewatering engine pump from overheating. The louver 1210 can be manually operated or operated automatically by an actuator system based on temperature sensed inside the enclosure by a temperature sensor. Further shown is a roof assembly, such as any of the foregoing described roof assemblies.

Figure 50:
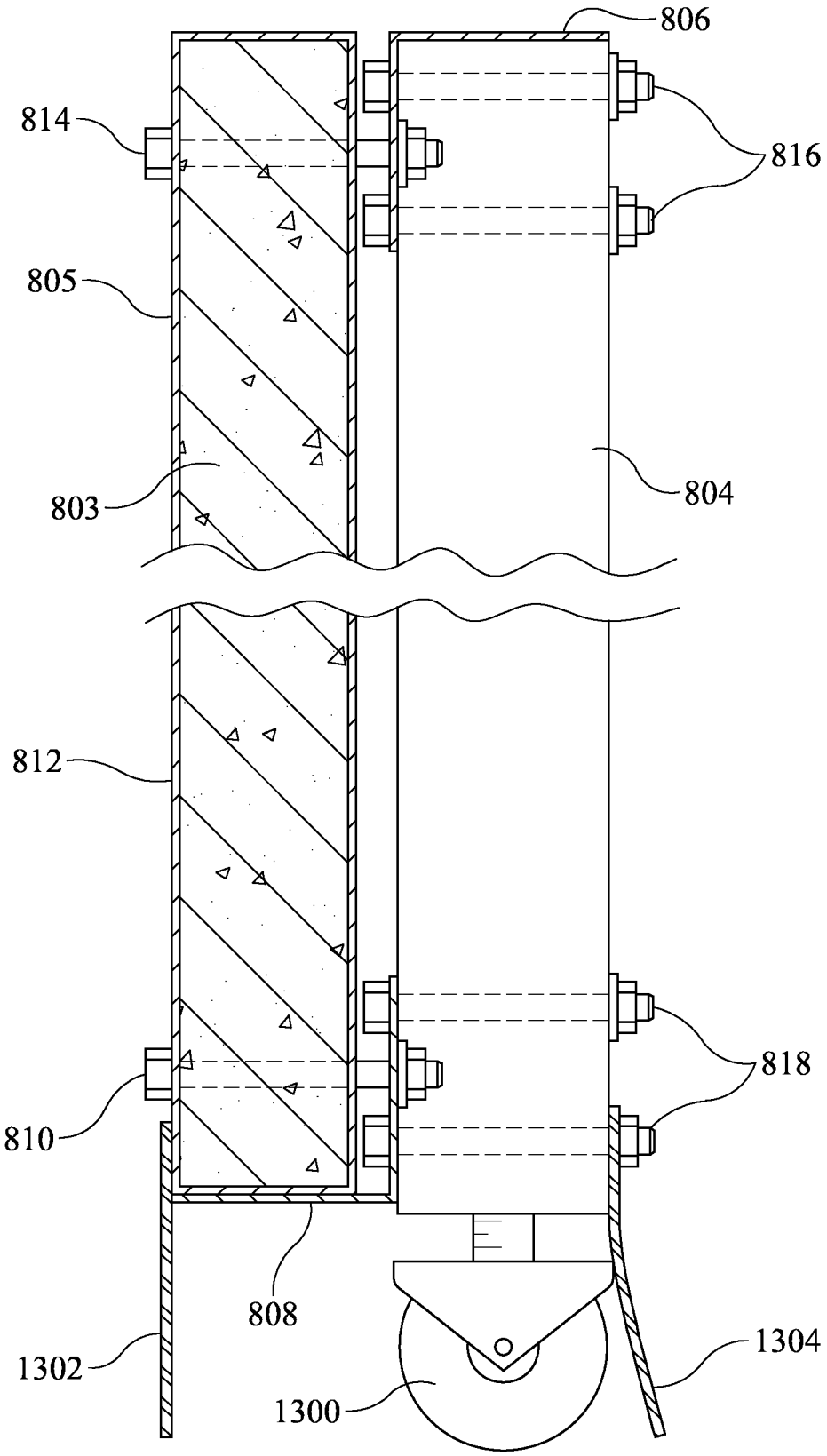
FIG. 50 is an illustrative, cross-sectional view, showing an insulated panel of a wall assembly secured and supported to a wall frame constructed in accordance with an embodiment of the invention.

With reference to FIG. 50, in certain instances it may be desirable to move the assembled enclosure. Accordingly, as depicted, the leveling feet can be replaced by casters 1300 that are threaded into the bottom of the vertical posts 804. The height of the casters 1300 can be adjusted so as to level the enclosure. Additionally, as depicted, sweep members 1302 and 1304 can be attached to the enclosure along the bottom of the insulated panels 812 on the exterior and interior of the enclosure. The purpose of the sweeps is to close the gap between the bottom of the enclosure and the grade caused by the dimensions of the casters to prevent heat and/or cooling from escaping from the interior of the enclosure.

While the invention has been particularly shown and described with respect to the illustrated embodiments thereof, it will be understood by those skilled in the art that the foregoing and other changes in form and details may be made therein without departing from the spirit and scope of the invention. For example, none of the foregoing described embodiments should be considered mutually exclusive unless otherwise stated.

What is claimed is:

1. A modular protective enclosure comprising:

a wall frame constructed of a plurality of vertical frame members spaced from one another and forming a perimeter of an enclosure, the vertical frame members being connected at the tops thereof by a plurality of first L-shaped angle-iron members by threaded fasteners extending through a first flange of the first L-shaped angle-iron members and through the vertical frame members, and being connected at the bottoms thereof by a plurality of second L-shaped angle-iron members by threaded fasteners extending through a first flange of the second L-shaped angle-iron members and through the vertical frame members and with a second flange of the second L-shaped angle-iron members extending outwardly from vertical frame members;

a plurality of insulated wall panels secured to the wall frame with the bottoms thereof supported upon the second flange of one or more of the second L-shaped angle-iron members of and by threaded fasteners extending through the insulated wall panels and the first flange of the second L-shaped angle-iron members and forming a continuous wall around the perimeter of the enclosure; and a roof assembly attached to the wall frame at the top of wall frame.

2. The modular protective enclosure of claim 1, further comprising:

a first door through a wall panel along one side of the enclosure;

a second door through a wall panel along a second side of the enclosure; and a double door assembly on a third side of the enclosure, the double door assembly including a pair of hinged door panels that are configured to open outwardly and close together in an overlapped joint therebetween.

3. The modular protective enclosure of claim 1, wherein the roof assembly is pivotally attached at a hinge side to the enclosure by one or more roof hinges and is rotatable about a hinge axis between a lowered position wherein the roof assembly closes an top opening of the enclosure and a raised position wherein the roof assembly is rotated about the hinge axis such that a side of the roof assembly that is opposite the hinge side moves in a direction upwardly from the wall frame and an interior of the enclosure is accessible through the top opening.

4. The modular protective enclosure of claim 3, further comprising:

a winch;

a cable wound on the winch and attached at its opposite end to the roof assembly at a side opposite of the one or more roof hinges.

5. The modular protective enclosure of claim 3, further comprising:

one or more toggle latches for locking the roof assembly in the closed position.

6. The modular protective enclosure of claim 1, wherein:

the roof assembly includes one or more roof panel members, wherein each roof panel member includes a broad exterior side, an broad interior side that is spaced from said broad exterior side defining a thickness therebetween, a first edge, a second edge opposite said first edge, a third edge substantially perpendicular to and extending between said first and said second edges, a fourth edge opposite to and substantially parallel to said third edge, wherein said distance between said third edge and said fourth edge defines a predetermined length, said first edge defining a groove extending therealong, said second edge defining a tongue extending therealong, and said roof assembly defining a perimeter having a plurality of wall sides; and further comprising:

a plurality of sidewall assemblies at predetermined sides of said wall sides with the adjoining vertical ends of said sidewall assemblies being connected by said wall corner connector panels, wherein each of said sidewall assemblies including one or more sidewall panel members, wherein each of said sidewall panel members has a top edge, a bottom edge opposite said top edge, a left side edge substantially perpendicular to and extending between said top and said bottom edges, said left edge defining a tongue, and said right edge defining a groove.

7. The modular protective enclosure of claim 6, wherein at least one sidewall panel member of two or more sidewall assemblies are sidewall door panel members, each sidewall door panel member having a hinged door, a light attached to an exterior side of the sidewall door panel member, and a light attached to an interior side of the sidewall door panel member, and a space heater mounted to the interior side of the sidewall door panel member.

8. The modular protective enclosure of claim 1, further comprising:

a louver formed through at least one side wall panel.

9. The modular protective enclosure of claim 1, wherein at least one of the wall panels includes a through hole for a pipeline, and further comprising a bristle-brush seal around the through hole to make sealing contact with the pipeline to prevent air from flowing across the at least one wall panel.

10. The modular protective enclosure of claim 1, further comprising:

a double door assembly on a third side of the enclosure, the double door assembly including a pair of hinged door panels that are configured to open outwardly and close together in an overlapped joint therebetween; and a bristle-brush seal attached to the bottom of each door panel.

11. The modular protective enclosure of claim 1, wherein the vertical frame members include an adjustable leveling foot at the bottoms thereof.

12. The modular protective enclosure of claim 1, wherein the roof assembly is secured to one or more of the plurality of first L-shaped angle-iron members by threaded fasteners.

13. A modular protective enclosure comprising:

a wall frame constructed of a plurality of vertical frame members spaced from one another and forming a perimeter of an enclosure, the vertical frame members being connected at the tops thereof by a plurality of first L-shaped angle-iron members by threaded fasteners extending through a first flange of the first L-shaped angle-iron members and through the vertical frame members, and being connected at the bottoms thereof by a plurality of second L-shaped angle-iron members by threaded fasteners extending through a first flange of the second L-shaped angle-iron members and through the vertical frame members and with a second flange of the second L-shaped angle-iron members extending outwardly from vertical frame members;

a plurality of insulated wall panels secured to the wall frame with the bottoms thereof supported upon the second flange of one or more of the second L-shaped angle-iron members and by threaded fasteners extending through the insulated wall panels and the first flange of the second L-shaped angle-iron members and forming a continuous wall around the perimeter of the enclosure;

a roof assembly attached to the wall frame at the top of wall frame;

the roof assembly includes one or more roof panel members, wherein each roof panel member includes a broad exterior side, an broad interior side that is spaced from said broad exterior side defining a thickness therebetween, a first edge, a second edge opposite said first edge, a third edge substantially perpendicular to and extending between said first and said second edges, a fourth edge opposite to and substantially parallel to said third edge, wherein said distance between said third edge and said fourth edge defines a predetermined length, said first edge defining a groove extending therealong, said second edge defining a tongue extending therealong, and said roof assembly defining a perimeter having a plurality of wall sides; and further comprising:

a plurality of sidewall assemblies at predetermined sides of said wall sides with the adjoining vertical ends of said sidewall assemblies being connected by said wall corner connector panels, wherein each of said sidewall assemblies including one or more sidewall panel members, wherein each of said sidewall panel members has a top edge, a bottom edge opposite said top edge, a left side edge substantially perpendicular to and extending between said top and said bottom edges, said left edge defining a tongue, and said right edge defining a groove; and wherein at least one of the wall panels includes a through hole for a pipeline, and further comprising a bristle-brush seal around the through hole to make sealing contact with the pipeline to prevent air from flowing across the at least one wall panel.

14. The modular protective enclosure of claim 13, wherein at least one sidewall panel member of two or more sidewall assemblies are sidewall door panel members, each sidewall door panel member having a hinged door, a light attached to an exterior side of the sidewall door panel member, and a light attached to an interior side of the sidewall door panel member, and a space heater mounted to the interior side of the sidewall door panel member.

15. The modular protective enclosure of claim 13, wherein the roof assembly is pivotally attached at a hinge side to the enclosure by one or more roof hinges and is rotatable about a hinge axis between a lowered position wherein the roof assembly closes an top opening of the enclosure and a raised position wherein the roof assembly is rotated about the hinge axis such that a side of the roof assembly that is opposite the hinge side moves in a direction upwardly from the wall frame and an interior of the enclosure is accessible through the top opening.

16. The modular protective enclosure of claim 15, further comprising:

a winch;

a cable wound on the winch and attached at its opposite end to the roof assembly at a side opposite of the one or more roof hinges.

17. The modular protective enclosure of claim 15, further comprising:

one or more toggle latches for locking the roof assembly in the closed position.

* * * * *